US008252501B2

(12) United States Patent
Maezawa et al.

(10) Patent No.: US 8,252,501 B2
(45) Date of Patent: Aug. 28, 2012

(54) METHOD OF MANUFACTURING COALESCED RESIN PARTICLES, COALESCED RESIN PARTICLES, TONER, TWO-COMPONENT DEVELOPER, DEVELOPING DEVICE, AND IMAGE FORMING APPARATUS

(75) Inventors: Nobuhiro Maezawa, Osaka (JP); Katsuru Matsumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 453 days.

(21) Appl. No.: 12/508,774

(22) Filed: Jul. 24, 2009

(65) Prior Publication Data

US 2010/0021210 A1 Jan. 28, 2010

(30) Foreign Application Priority Data

Jul. 25, 2008 (JP) ..... P2008-192880

(51) Int. Cl.
*G03G 5/00* (2006.01)

(52) U.S. Cl. ..... 430/137.14; 430/137.1

(58) Field of Classification Search ..... 430/137.1, 430/137.11, 137.12, 137.14
See application file for complete search history.

(56) References Cited

U.S. PATENT DOCUMENTS

| | | | |
|---|---|---|---|
| 5,424,162 | A | 6/1995 | Kohri et al. |
| 5,552,502 | A | 9/1996 | Odell et al. |
| 5,725,987 | A | 3/1998 | Combes et al. |
| 5,843,614 | A | 12/1998 | Shinzo et al. |
| 5,885,743 | A | 3/1999 | Takayanagi et al. |
| 6,017,670 | A | 1/2000 | Hashizume et al. |
| 6,270,708 | B1 | 8/2001 | Gurol |
| 6,858,369 | B1 | 2/2005 | Adachi et al. |
| 7,284,899 | B2 | 10/2007 | Nakano |
| 7,402,371 | B2 | 7/2008 | Sacripante et al. |
| 7,575,843 | B2 | 8/2009 | Matsumoto et al. |
| 7,659,045 | B2 | 2/2010 | Shibai et al. |
| 8,067,143 | B2 | 11/2011 | Kikawa et al. |
| 2002/0042014 | A1 | 4/2002 | Fujino et al. |
| 2002/0160289 | A1 | 10/2002 | Teshima et al. |
| 2004/0110078 | A1 | 6/2004 | Teshima et al. |

(Continued)

FOREIGN PATENT DOCUMENTS

CN 1408079 A 4/2003

(Continued)

OTHER PUBLICATIONS

U.S. Office Action mailed Nov. 21, 2008 in corresponding U.S. Appl. No. 11/652,482.

*Primary Examiner* — Mark F Huff
*Assistant Examiner* — Stewart Fraser
(74) *Attorney, Agent, or Firm* — Nixon & Vanderhye P.C.

(57) ABSTRACT

There is provided a method of manufacturing coalesced resin particles for obtaining coalesced resin particles by coalescing aggregated resin particles in a grain boundary-free state in a short period of time while keeping a grain size distribution within a narrow range. In a coalescence process, a slurry of aggregated resin particles is flowed through an inside of a pipe under predetermined heating and pressurizing conditions. In a before-cooling decompression process, a slurry of coalesced resin particles flowing through the inside of the pipe in a heat and pressure-applied state is subjected to pressure reduction before it is cooled down to a predetermined temperature in a cooling process. Then, in a decompression process, a coalesced resin particle slurry that has been cooled in the cooling process while being flowed through the inside of the pipe is decompressed to an atmospheric pressure.

5 Claims, 5 Drawing Sheets

U.S. PATENT DOCUMENTS

| | | | | |
|---|---|---|---|---|
| 2005/0041523 | A1 | 2/2005 | Nakano | |
| 2006/0160012 | A1 | 7/2006 | Hirose et al. | |
| 2007/0020553 | A1 | 1/2007 | Marcello et al. | |
| 2007/0128533 | A1 | 6/2007 | Sata et al. | |
| 2007/0166638 | A1 | 7/2007 | Matsumoto et al. | |
| 2007/0196754 | A1 | 8/2007 | Matsumoto et al. | |
| 2007/0196756 | A1* | 8/2007 | Shibai et al. | 430/108.1 |
| 2008/0029924 | A1 | 2/2008 | Maezawa et al. | |
| 2008/0063970 | A1* | 3/2008 | Kikawa et al. | 430/110.2 |
| 2009/0042119 | A1 | 2/2009 | Matsumoto et al. | |
| 2010/0021210 | A1 | 1/2010 | Maezawa et al. | |

FOREIGN PATENT DOCUMENTS

| | | | |
|---|---|---|---|
| CN | 1615175 | A | 5/2005 |
| JP | 63-278547 | | 11/1988 |
| JP | 03-056969 | | 3/1991 |
| JP | 04-174861 | | 6/1992 |
| JP | 07-075666 | | 8/1995 |
| JP | 08-146657 | | 6/1996 |
| JP | 09-277348 | | 10/1997 |
| JP | 10-186714 | | 7/1998 |
| JP | 2001-209212 | | 8/2001 |
| JP | 2001-324831 | | 11/2001 |
| JP | 2002/351140 | | 12/2002 |
| JP | 2003-066649 | | 3/2003 |
| JP | 2003-345063 | A | 12/2003 |
| JP | 2005-128176 | | 5/2005 |
| JP | 2005-165039 | | 6/2005 |
| JP | 2006-91882 | | 4/2006 |
| JP | 2006-189710 | | 7/2006 |
| JP | 2007-34290 | A | 2/2007 |
| JP | 2007-108458 | | 4/2007 |
| JP | 2007-219451 | | 8/2007 |
| WO | 01/84248 | A1 | 11/2001 |
| WO | WO03/059497 | | 7/2003 |
| WO | WO 03/059497 | | 7/2003 |

* cited by examiner

METHOD OF MANUFACTURING COALESCED RESIN PARTICLES, COALESCED RESIN PARTICLES, TONER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2008-192880, which was filed on Jul. 25, 2008, the contents of which are incorporated herein by reference in their entirety.

BACKGROUND OF THE INVENTION

1. Field of the Invention

The present invention relates to a method of manufacturing coalesced resin particles, coalesced resin particles, a toner, a two-component developer, a developing device, and an image forming apparatus.

2. Description of the Related Art

In an image forming apparatus of the electrophotographic system, a toner which is electrically charged is fed to an electrostatic latent image formed on the surface of a photoreceptor to develop the electrostatic latent image into a toner image which is, thereafter, fixed on a recording medium to form an image.

According to this system, the toner is uniformly attached onto the electrostatic latent image to form an image having a high image density and excellent image quality. From the standpoint of adhering the toner onto the electrostatic latent image, it is important that the toner has even particle sizes, the width of particle size distribution is narrow, and the electrically charging property is uniform.

The particle size of the toner affects not only the electrically-charging property but also the reproduction of image of the document maintaining high degree of fineness. The toner having suitably small particle sizes, i.e., particle sizes of about 5 to about 6 μm is effective in obtaining highly finely copied images.

Accordingly, various researches and studies have heretofore been made in an effort to achieve uniformization of toner particle size and to obtain toner particles of reduced diameter. For example, there is known a toner manufacturing method employing an aggregation technique to achieve uniformization of toner particle size. According to the aggregation technique, for example, a flocculating agent such as a bivalent or trivalent metal salt is added to an aqueous slurry in which are dispersed fine resin particles, colorant particles, release agent particles, and so forth to thereby cause the resin particles, the colorant particles, and the release agent particles to clump together. In this way, aggregated particles serving as toner particles can be produced. However, there are problems to be solved in respect of the aggregation technique. For example, when excessive aggregation occurs, there are produced particles that are larger in particle size than they need to be, in consequence whereof there results a broadening in the range of grain size distribution of the aggregated particles. Furthermore, in order to control the particle size of the aggregated particles properly, a long time needs to be taken to develop aggregation reactions.

In order to solve such problems, for example, Japanese Unexamined Patent Publication JP-A 2007-108458 discloses a toner manufacturing method which comprises a step of emulsifying a binder resin containing polyester in an aqueous medium and a step of adding a water-soluble compound containing nitrogen having a molecular weight of 350 or less to the resultant binder resin emulsified liquid thereby to cause emulsified particles to clump together. According to this toner manufacturing method, with use of a polyester-containing binder resin, but without the necessity of using an organic solvent essentially, it is possible to exercise toner-particle shape control properly in a simple manner and in a short manufacturing time, as well as to produce a toner of a grain size distribution within a narrow range.

In the toner manufacturing method disclosed in JP-A 2007-108458, in order to obtain coalesced resin particles free from grain boundaries, when toner particles are changed from an aggregated resin particle form to a coalesced resin particle form, there is a need to agitate the particles for a long period of time while heating them to a temperature close to a softening temperature of the binder resin. This gives rise to a problem of productivity. Furthermore, since the particles are kept under a high-temperature condition for a long period of time, it follows that a low-melting-point component (a release agent, for instance) contained in the aggregated resin particles is desorbed and is eventually exposed at the surface of the aggregated resin particles. This leads to occurrence of a filming on the surface of a photoreceptor and thus to image imperfection.

SUMMARY OF THE INVENTION

Accordingly, an object of the invention is to provide a method of manufacturing coalesced resin particles for obtaining coalesced resin particles by coalescing aggregated resin particles in a grain boundary-free state in a short period of time while keeping a grain size distribution within a narrow range, as well as to provide coalesced resin particles. Another object of the invention is to provide a toner which contains the coalesced resin particles, and a two-component developer which contains the toner. Still another object of the invention is to provide a developing device for performing development with use of a developer or two-component developer which contains the toner, and an image forming apparatus equipped with the developing device.

The invention provides a method of manufacturing coalesced resin particles comprising:

a coalescence process of causing an aggregated resin particle slurry, which is prepared by dispersing in a fluid medium aggregated resin particles composed of an aggregate of fine resin particles containing at least a resin, to flow through an inside of a pipe while being heated to a predetermined temperature and pressurized in such a manner that a pressure exerted thereon falls in a range of 0.5 MPa or more and 15 MPa or less, thereby to obtain a coalesced resin particle slurry, which is prepared by dispersing in the fluid medium coalesced resin particles formed through coalescence of aggregated resin particles; and a cooling and decompression process of allowing the coalesced resin particle slurry flowing through the inside of the pipe in a heat and pressure-applied state to be cooled down to a predetermined temperature and decompressed to a predetermined pressure.

According to the invention, in the coalescence process, the aggregated resin particle slurry is flowed through the inside of the pipe under predetermined heating and pressurizing conditions. By effecting the compression transportation of the aggregated resin particle slurry under the predetermined pressurizing condition, it is possible to secure a flow rate in which the aggregated resin particle slurry flows without causing settlement of the aggregated resin particles within the pipe.

Moreover, being heated to a predetermined temperature, the aggregated resin particles can be coalesced into coalesced resin particles in a grain boundary-free state in a short period of time. Further, in the cooling and decompression process, the coalesced resin particle slurry is cooled down to a predetermined temperature and decompressed to a predetermined pressure. This makes it possible to prevent a broadening in grain size distribution range caused by aggregation of the coalesced resin particles, and thus obtain coalesced resin particles having a grain size distribution within a narrow range.

Further, in the invention, it is preferable that the cooling and decompression process includes:

a before-cooling decompression step of decompressing the coalesced resin particle slurry flowing through the inside of the pipe in a heat and pressure-applied state to a pressure level of higher than an atmospheric pressure but lower than the pressure set for the coalescence process;

a cooling step of cooling down the coalesced resin particle slurry that has undergone pressure reduction in the before-cooling decompression step while being flowed through the inside of the pipe to a predetermined temperature; and a decompression step of decompressing the coalesced resin particle slurry that has been cooled in the cooling step while being flowed through the inside of the pipe to an atmospheric pressure.

According to the invention, the cooling and decompression process includes the before-cooling decompression step, the cooling step, and the decompression step. In the before-cooling decompression step, the coalesced resin particle slurry flowing through the inside of the pipe in a heat and pressure-applied state is subjected to pressure reduction before it is cooled down to a predetermined temperature in the cooling step. This makes it possible to suppress occurrence of a turbulent flow within the pipe entailed by development of cavitation, and thereby prevent a broadening in grain size distribution range caused by aggregation of the coalesced resin particles. In consequence, there is shown a remarkable effect of producing coalesced resin particles having a grain size distribution within a narrow range.

Further, in the decompression step, the coalesced resin particle slurry that has been cooled in the cooling step while being flowed through the inside of the pipe is decompressed to an atmospheric pressure. That is, the coalesced resin particle slurry is subjected to step-by-step pressure reduction in the before-cooling decompression step which is conducted prior to the cooling step and in the decompression step which is conducted after the cooling step. In this way, by performing pressure reduction on the coalesced resin particle slurry in a stepwise manner, it is possible to suppress evaporation of the fluid medium from the slurry, and thereby prevent occurrence of fusion and coagulation of the coalesced resin particles within the pipe. In consequence, there are obtained coalesced resin particles having a grain size distribution within a narrow range.

Further, in the invention, it is preferable that a level of pressure set for the coalescence process falls in a range of 0.5 MPa or more and 5 MPa or less.

According to the invention, in the coalescence process, the aggregated resin particle slurry is pressurized in such a manner that the pressure exerted thereon falls in a range of 0.5 MPa or more and 5 MPa or less. This makes it possible to secure a flow rate at which the aggregated resin particle slurry flows without causing settlement of the aggregated resin particles within the pipe. Moreover, the aggregated resin particles can be coalesced into coalesced resin particles in a grain boundary-free state in a short period of time.

Further, in the invention, it is preferable that a level of pressure set for the coalescence process falls in a range of 1 MPa or more and 2 MPa or less.

According to the invention, in the coalescence process, the aggregated resin particle slurry is pressurized in such a manner that the pressure exerted thereon falls in a range of 1 MPa or more and 2 MPa or less. This makes it possible to secure a flow rate in which the aggregated resin particle slurry flows without causing settlement of the aggregated resin particles within the pipe. Moreover, there is shown a remarkable effect of producing coalesced resin particles successfully by achieving coalescence of the aggregated resin particles in a grain boundary-free state in a short period of time.

Further, in the invention, it is preferable that the predetermined temperature set for the coalescence process falls in a range of ((a softening temperature of the aggregated resin particles)−10)° C. or above and ((a softening temperature of the aggregated resin particles)+80)° C. or below.

According to the invention, in the coalescence process, the aggregated resin particle slurry is heated at a temperature in a range of ((a softening temperature of the aggregated resin particles)−10)° C. or above and ((a softening temperature of the aggregated resin particles)+80)° C. or below. In this way, even if the slurry has a high concentration of the aggregated resin particles, coalesced resin particles free from grain boundaries are obtainable.

Further, in the invention, it is preferable that a specific heat of the aggregated resin particle slurry falls in a range of 4.3 J/g·° C. or more and 8.0 J/g·° C. or less.

According to the invention, the specific heat of the aggregated resin particle slurry falls in a range of 4.3 J/g·° C. or more and 8.0 J/g·° C. or less. In this case, too large a rise in heating temperature can be suppressed, and besides coalesced resin particles free from grain boundaries are obtainable without causing a decline in productivity.

Further, in the invention, it is preferable that a volume average particle size of the aggregated resin particles falls in a range of 3 μm or more and 10 μm or less.

According to the invention, the volume average particle size of the aggregated resin particles falls in a range of 3 μm or more and 10 μm or less. In this case, heat is easily transmitted to the aggregated resin particles interiorly thereof, wherefore it is possible to obtain highly-durable coalesced resin particles free from grain boundaries. If the volume average particle size of the aggregated resin particles is less than 3 μm, mutual aggregation of the aggregated resin particles will take place easily. In contrast, if the volume average particle size of the aggregated resin particles is greater than 10 μm, it will be difficult to obtain coalesced resin particles free from grain boundaries due to unsatisfactory heat transmission.

Further, the invention provides coalesced resin particles that are produced by the method of manufacturing coalesced resin particles as set forth hereinabove.

According to the invention, being produced by the aforestated method of manufacturing coalesced resin particles, the coalesced resin particles have a grain size distribution within a narrow range, are free from grain boundaries, and exhibit high durability.

Further, the invention provides a toner comprising toner particles composed of the coalesced resin particles produced by the method of manufacturing coalesced resin particles as set forth hereinabove.

According to the invention, being produced by the aforestated manufacturing method, the toner has a grain size distribution within a narrow range, is free from grain boundaries, and exhibits high durability. Accordingly, the toner can withstand long-time agitation in a developer tank or the like.

Further, the invention provides a two-component developer comprising the toner mentioned above and a carrier.

According to the invention, the two-component developer comprises the toner mentioned above and a carrier, and thus can offer high charging stability for a longer period of time.

Further, the invention provides a developing device for effecting the developing by using a developer containing the toner mentioned above or the two-component developer mentioned above.

According to the invention, there is realized a developing device for effecting the developing by using a developer containing the toner mentioned above or the two-component developer mentioned above.

Further, the invention provides an image forming apparatus equipped with a developing device mentioned above.

According to the invention, there is realized an image forming apparatus equipped with the developing device.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
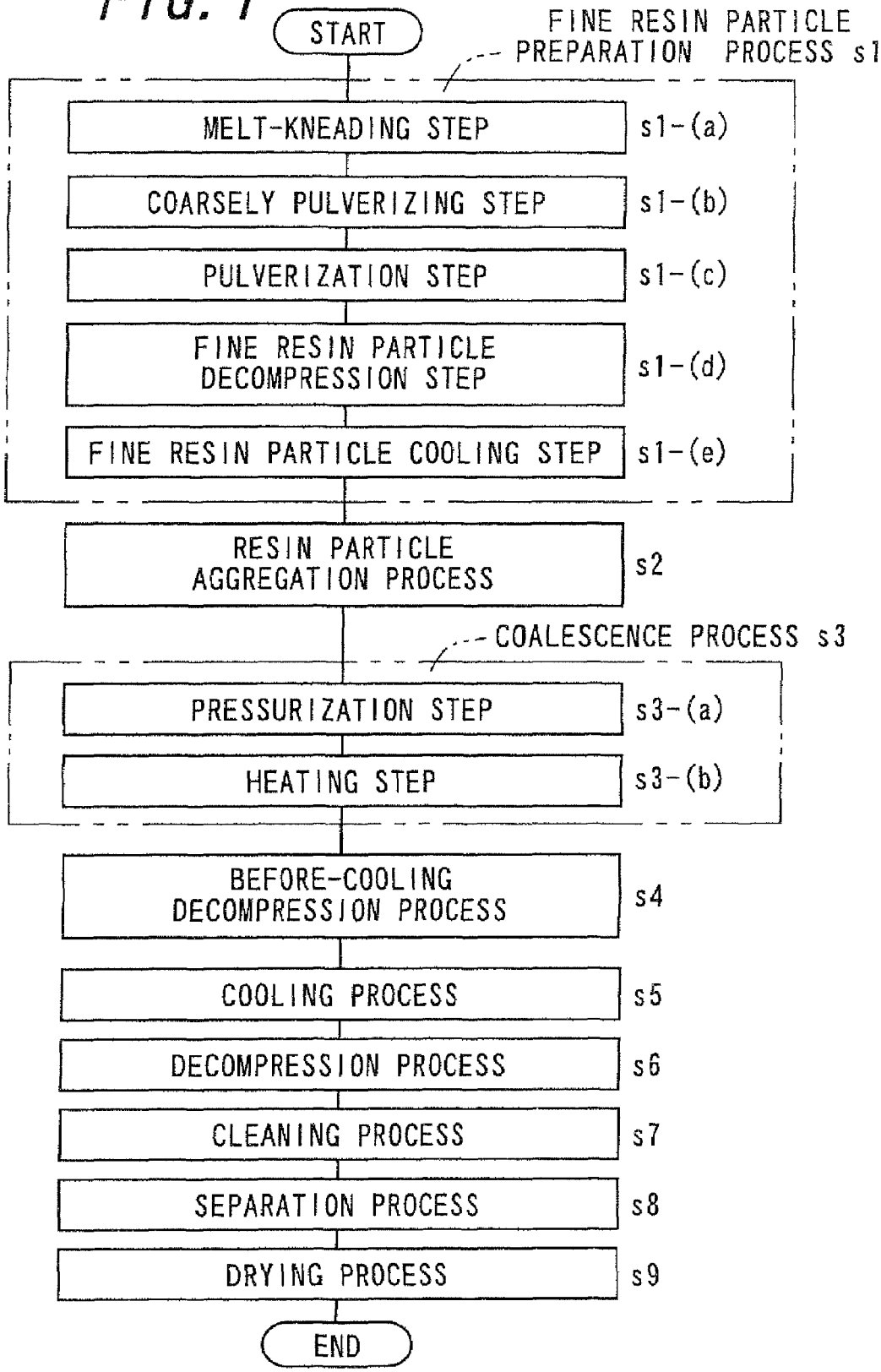
FIG. 1 is a flow chart showing a procedure of a method of manufacturing coalesced resin particles in accordance with one embodiment of the invention.

Now referring to the drawings, preferred embodiments of the invention will be described in detail.

A method of manufacturing coalesced resin particles according to the invention comprises: a fine resin particle preparation process of preparing a fine resin particle slurry by dispersing fine resin particles containing at least resin in a fluid medium; a resin particle aggregation process of causing the fine resin particles contained in the fine resin particle slurry to clump together, thereby to obtain an aggregated resin particle slurry; a coalescence process of coalescing the aggregated resin particles under predetermined heating and pressurizing conditions, thereby to obtain a coalesced resin particle slurry; a before-cooling decompression process of decompressing the coalesced resin particle slurry to a predetermined pressure; a cooling process of cooling the coalesced resin particle slurry down to a predetermined temperature; and a decompression process of decompressing the coalesced resin particle slurry to an atmospheric pressure. As employed herein, "coalescence" refers to fusion and unification of the aggregated resin particles under application of heat.

For example, the coalesced resin particles produced by the manufacturing method of the invention may find applications in a toner for use as a developer in an electrophotographic image forming apparatus, a resin spacer for supporting a glass substrate with a sealed-in liquid crystal material, and the like.

FIG. 1 is a flow chart showing a procedure of a method of manufacturing coalesced resin particles in accordance with one embodiment of the invention.

[Fine Resin Particle Preparation Process]

The fine resin particle preparation process of Step s1 includes: a melt-kneading step of Step s1-(*a*); a coarsely pulverizing step of Step s1-(*b*); a pulverization step of Step s1-(*c*); a fine resin particle decompression step of Step s1-(*d*); and a fine resin particle cooling step of Step s1-(*e*). The fine resin particle preparation process is a process of preparing a fine resin particle slurry by dispersing fine resin particles containing at least resin in a fluid medium.

The examples of a resin adaptable for use in the invention include a polyester resin, a styrenic resin such as polystyrene and a styrene-acrylic acid ester copolymer resin, an acrylic resin such as polymethyl methacrylate, a polyolefin resin such as polyethylene, a polyurethane resin, and an epoxy resin. In the case of using the coalesced resin particles of the invention for toner application purposes, the use of a polyester resin, an acrylic resin, or an epoxy resin is particularly desirable from the viewpoint of providing excellent transparency, imparting satisfactory powder fluidity, low-temperature fixability, secondary color reproducibility, and so forth to coalesced resin particles or toner particles to be obtained, and offering suitability for use as a binder resin in a color toner. In addition, a combination of a polyester resin and an acrylic resin in a grafted state can also be used from the viewpoint of achieving low-temperature fixation of a toner.

With consideration given to facilitation of the granulation operation, uniformization of the shapes and sizes of particles to be obtained, and the like, it is desirable to use resins whose softening temperature is lower than or equal to 150° C., and more preferably falls in a range of from 60 to 150° C. Among them, a resin of which weight average molecular weight falls in a range of from 50000 to 300000 is particularly desirable for use. In the case of using the coalesced resin particles of the invention for toner application purposes, if the weight average molecular weight of the resin in use is less than 50000, there arises the possibility of omission of part of images or the like phenomenon due to the lowness in mechanical strength of a toner in a fixed state. In contrast, if the weight average molecular weight is greater than 300000, there arises the possibility of a decline in low-temperature fixability.

the resins may be used each alone, or two or more of them of different types may be used in combination. It may also use a plurality of resin materials that are of the same resin system in essence but differ from each other in any or all of molecular weight, monomer composition, and so forth.

(Melt-Kneading Step)

The melt-kneading step of Step s1-(*a*) is a step of melt-kneading the resin and other materials to form a resin-containing melt-kneaded product. In the case of producing coalesced resin particles applicable to a toner, this step forms a melt-kneaded product composed of the resin containing a colorant, a release agent, a charge control agent, and the like. On the other hand, in the case producing coalesced resin particles applicable to a resin spacer for liquid crystal construction, the melt-kneading step can be omitted.

As the colorant for toner, dyestuffs and pigments are suited for use. Particularly the use of pigments is desirable, because pigments gain an advantage over dyestuffs in terms of light-fastness and bright coloration. That is, the use of pigments makes it possible to obtain a toner that is excellent in light-fastness and bright coloration. The examples of the colorant include a colorant for yellow toner, a colorant for magenta toner, a colorant for cyan toner, and a colorant for black toner.

As the colorant for yellow toner, those that are classified according to the Color Index are suited for use. The examples thereof include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180, and C.I. Pigment Yellow 185; inorganic pigments such as yellow iron oxide and yellow ocher; nitro-based dyes such as C.I. Acid Yellow 1; and oil soluble dyes such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21.

As the colorant for magenta toner, those that are classified according to the Color Index are suited for use. The examples thereof include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10, and C.I. Disperse Red 15.

As the colorant for cyan toner, those that are classified according to the Color Index are suited for use. The examples thereof include C.I. Pigment Blue 15, C.I. Pigment Blue 16, C.I. Solvent Blue 55, C.I. Solvent Blue 70, C.I. Direct Blue 25, and C.I. Direct Blue 86.

The examples of the colorant for black toner include carbon black such as channel black, roller black, disk black, gas furnace black, oil furnace black, thermal black, and acetylene black.

Other than the aforementioned pigments, for example, bright red pigments and green pigments can be used for the colorant. Colorants may be used each alone, or two or more of them of different colors may be used in combination. It is also possible to use a plurality of similar-hue colorants in combination. It is preferable that the colorant is used in the form of master batch. For example, a master batch of the colorant can be produced by kneading a melted product of a resin and the colorant. As the resin, a resin of the same kind as the binder resin for toner or a resin which exhibits excellent compatibility with the binder resin for toner may be used. Although the ratio in usage between the resin and the colorant in the master batch is not particularly restricted, it is preferable that the amount of the colorant falls in a range of 30 parts by weight or more and 100 parts by weight or less based on 100 parts by weight of the synthetic resin.

Moreover, although the content of the colorant is not particularly restricted, it is preferable that the colorant is blended in an amount ranging from 4 parts by weight to 20 parts by weight based on 100 parts by weight of the binder resin. In this way, it is possible to suppress a filler effect induced by the addition of the colorant, as well as to obtain a toner which delivers high coloring performance. If the blending amount of the colorant is greater than 20 parts by weight, there arises the possibility of a decline in toner fixability due to the filler effect of the colorant.

The release agent for toner is added to impart releasability to a toner at the time when it is fixed onto a recording medium. Therefore, in contrast to a case where no release agent is used, it is possible to achieve a rise in high-temperature offset start temperature and thereby yield an improvement in high-temperature offset resistance. Moreover, through the application of heat for toner fixation, the release agent is caused to melt, and the fixing start temperature is decreased. This makes it possible to yield a hot-offset resistance improvement. There is no particular limitation to the release agent for use in the invention, and thus heretofore known ones can be used. The examples thereof include: a petroleum wax such as a paraffin wax and its derivatives and a microcrystalline wax and its derivatives; a hydrocarbon-based synthetic wax such as a Fischer-Tropsch wax and its derivatives, a polyolefin wax and its derivatives, a low-molecular weight polypropylene wax and its derivatives, and a polyolefin-based polymer wax and its derivatives; a carnauba wax and its derivatives; and an ester-based wax. Although the amount of the release agent to be used is not particularly restricted and can thus be selected in a wide adequate range, preferably it should fall in a range of from 0.2 parts by weight to 20 parts by weight based on 100 parts by weight of the binder resin. If the content of the release agent is greater than 20 parts by weight, there arises the possibility that an undesirable phenomenon such as toner-filming on a photoreceptor and toner-spent on carrier tends to occur. In contrast, if the content of the release agent is less than 0.2 parts by weight, there arises the possibility of a failure to make full use of the performance capability of the release agent. There is no particular limitation to the melting point of the release agent. However, if the melting point is unduly high, the effect of improving the fixability (releasability) cannot be expected, and in contrast, if the melting point is unduly low, for example, the storage stability could be deteriorated. Accordingly, it is preferable that the melting point falls in a range of from 30 to 120° C.

The charge control agent for toner is added to impart desirable chargeability to a toner. There is no particular limitation to the charge control agent for use in the invention, and thus heretofore known charge control agents for positive charge control or negative charge control can be used. The examples of the charge control agent for positive charge control include a basic dye, a quaternary ammonium salt, a quaternary phosphonium salt, aminopyrine, a pyrimidine compound, a multinuclear polyamino compound, aminosilane, a nigrosin dye and its derivatives, a triphenylmethane derivative, a guanidine salt, and an amidine salt. The examples of the charge control agent for negative charge control include an oil-soluble dye such as oil black and spiron black, ametallized azo compound, an azo complex dye, a naphthene acid metallic salt, a metallic complex and a metallic salt of salicylic acid and its derivatives (metal: chrome, zinc, zirconium, and the like), a boron compound, fatty acid soap, a long-chain alkylcarboxylic acid salt, and resin acid soap.

The charge control agents may be used each alone, or two or more of them of different types may be used in combination. The amount of a compatible charge control agent to be used should preferably fall in a range of from 0.5 parts by weight to 5 parts by weight, more preferably, from 0.5 parts by weight to 3 parts by weight, based on 100 parts by weight of the binder resin. If the content of the charge control agent is greater than 5 parts by weight, carrier contamination and toner scattering will take place. If the content of an incompatible charge control agent is less than 0.5 parts by weight, it becomes impossible to impart satisfactory charging characteristics to a toner.

The melt-kneaded product can be obtained by, for example, dry-mixing the resin and the colorant, and, on an as needed basis, the release agent and the charge control agent by a mixer, and kneading the resultant powder admixture by a kneading machine. The temperature for kneading is set to be higher than or equal to the melting temperature of the binder resin (in a range of approximately from 80 to 200° C. under normal circumstances, and preferably in a range of approximately from 100 to 150° C.)

For the melt-kneading operation, it is possible to use a commonly-used kneading machine such as a twin-screw extruder, a three-roll mill, and a Laboplast mill. To be more specific, exemplary thereof are, for example, single- or twin-screw extruders such as TEM-100B (trade name) manufactured by Toshiba Machine Co., Ltd. and PCM-65/87 (trade name) manufactured by Ikegai, Ltd., and kneaders of open roll type such as KNEADEX (trade name) manufactured by Mitsui Mining Co., Ltd. The resultant melt-kneaded product is turned into a solid product by the cooling operation, and the solid product of the melt-kneaded product obtained through cooling solidification is coarsely pulverized by a powder pulverizer such as a cutter mill, a feather mill, and a jet mill. In this way, coarse powder of the melt-kneaded product can be obtained. Although the particle size of the coarse powder is not particularly restricted, preferably it should fall in a range of from 450 to 1000 μm, and more preferably in a range of approximately from 500 to 800 μm.

(Coarsely Pulverizing Step)

The coarsely pulverizing step of Step s1-(*b*) is a step of coarsely pulverizing the resin (the one that has undergone the melt-kneading step is called "melt-kneaded product"; that is, the melt-kneaded product will hereafter be also referred to as "resin" in some cases) and whereafter dispersing it in a fluid medium, thereby to obtain a slurry containing coarse resin powder. Although there is no particular limitation to the fluid medium to be mixed with the resin so long as it is capable of dispersing the resin uniformly therein without causing dissolution, it is desirable to use a hydrophilic medium such as water and alcohol from the standpoints of easiness in process management, liquid waste disposal following the completion of all of the process steps, easiness in handling, and so forth. The mixing of the coarse resin powder with the fluid medium is carried out by a commonly-used mixer. In this way, there is obtained a slurry containing the coarse resin powder.

Next, the coarse resin powder contained in the coarse resin powder-containing slurry is pulverized. Although there is no particular limitation to how the coarse resin powder is to be pulverized and therefore any given heretofore known method may be adopted, it is preferable that the pulverization of the coarse resin powder is performed by a method which involves the pulverization step of Step s1-(*c*), the fine resin particle decompression step of Step s1-(*d*), and the fine resin particle cooling step of Step s1-(*e*), with use of a high-pressure homogenizer.

The examples of the high-pressure homogenizer include: high-pressure homogenizers of chamber type such as MICROFLUIDIZER (trade name) manufactured by Microfluidics International Corporation, NANOMIZER (trade name) manufactured by NANOMIZER Inc., and ULTIMIZER (trade name) manufactured by Sugino Machine Limited; HIGH-PRESSURE HOMOGENIZER (trade name) manufactured by Rannie Corporation; HIGH-PRESSURE HOMOGENIZER (trade name) manufactured by Sanmaru Machinery Co., LTD.; HIGH-PRESSURE HOMOGENIZER (trade name) manufactured by Izumi Food Machinery Co., Ltd.; and nano3000 (trade name) manufactured by Beryu Co., Ltd. In particular, the use of a high-pressure homogenizer described in WO03/059497 is desirable.

Figure 2:
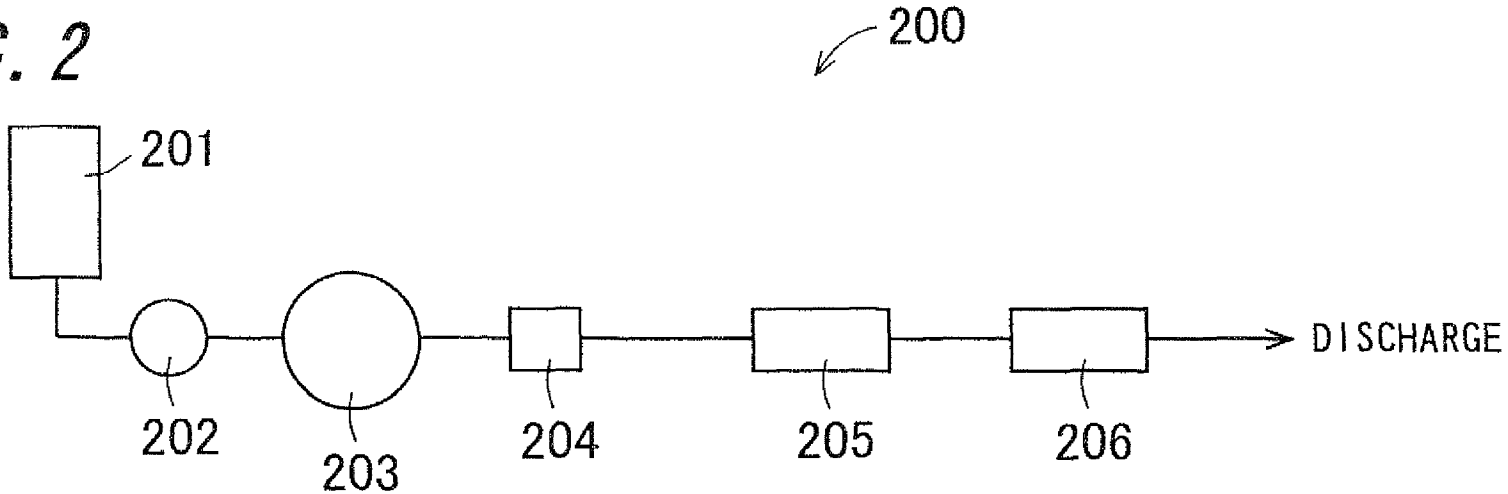
FIG. 2 is a diagram showing the structure of a high-pressure homogenizer.

FIG. 2 is a diagram showing the structure of a high-pressure homogenizer 200. The high-pressure homogenizer 200 includes a tank 201, a pressurization unit 202, a heater 203, a pulverization nozzle 204, a decompression module 205, and a cooling device 206. The tank 201 is a container-like member having an inner space for storing therein a slurry formed by dispersing the coarse resin powder in the fluid medium. The pressurization unit 202 applies a pressure to the coarse resin powder-containing slurry. The heater 203 applies heat to the coarse resin powder-containing slurry subjected to the pressure applied by the pressurization unit 202. The pulverization nozzle 204 allows the coarse resin powder-containing slurry in a heat and pressure-applied state to flow through a flow channel formed in the interior thereof, so that the coarse resin powder can be pulverized to thereby form a slurry of fine resin particles. The decompression module 205 performs pressure reduction on the fine resin particle slurry in a heat and pressure-applied state to prevent development of bubbles caused by bumping. The cooling device 206 cools down the fine resin particle slurry in a heated state.

(Pulverization Step)

The pulverization step of Step s1-(*c*) is a step of causing the coarse resin powder-containing slurry to flow through the flow channel formed in the pulverization nozzle 204 under application of heat and pressure by the high-pressure homogenizer 200 so that the coarse resin powder can be pulverized into fine resin particles, thereby to obtain a slurry of the fine resin particles.

The coarse resin powder-containing slurry is heated by the heater 203 to a temperature higher than the softening temperature of the coarse resin powder and is also subjected to a pressure by the pressurization unit 202. Then, the coarse resin powder-containing slurry is introduced into the pulverization nozzle 204 from the inlet thereof, whereupon the pulverization operation gets started.

At this time, in the regulation of the volume average particle size of the fine resin particles within a desired range, fine adjustment can be made for example by controlling the heating and pressurizing conditions to be fulfilled in the pulverization of the coarse resin powder, by controlling the speed, distance, and so forth as to the flowing passage of the coarse resin powder through the flow channel formed in the pulverization nozzle 204, and by making suitable adjustment to the concentration of solid content in the coarse resin powder slurry and the number of times for the pulverization.

(Fine Resin Particle Decompression Step)

The fine resin particle decompression step of Step s1-(*d*) is a step of decompressing the fine resin particle slurry in a heat and pressure-applied state. By the decompression module 205 of the high-pressure homogenizer 200, the fine resin particle slurry in a heat and pressure-applied state is decompressed to a pressure level where no bubbling (development of bubbles) occurs.

(Fine Resin Particle Cooling Step)

The fine resin particle cooling step of Step s1-(*e*) is a step of cooling down the fine resin particle slurry in a heated state. With use of the cooling device 206 of the high-pressure homogenizer 200, the cooling operation is carried out until the fluid temperature of the fine resin particle slurry is decreased to a temperature lower than or equal to the glass transition temperature of the fine resin particles.

[Resin Particle Aggregation Process]

The resin particle aggregation process of Step s2 is a process of adding a heretofore known flocculating agent used customarily in the relevant field to the fine resin particle slurry, and then causing the fine resin particles to clump together by a heretofore known granulation apparatus provided with an agitating section thereby to prepare an aggregated resin particle slurry.

In the resin particle aggregation process, the fluid temperature of the slurry is increased at a predetermined temperature elevation rate. The target temperature to be reached is set in a range of ±10° C. from the glass transition temperature (Tg) of the resin. The shape of the aggregated resin particles is dependent upon the target temperature to be reached. If the target temperature to be reached is lower than a temperature of ((Tg of Resin)−10)° C., aggregation will be prevented from taking place readily. In contrast, if the target temperature to be reached is higher than a temperature of ((Tg of Resin)+10)° C., excessive aggregation will occur.

Moreover, in the mixing of the fine resin particle slurry with the flocculating agent, by properly selecting the speed of agitation performed by the agitating section, the temperature to be reached during the agitation, the temperature elevation rate, and the amount of the flocculating agent to be added, it is possible to obtain aggregated resin particles having a desired volume average particle size. It is preferable that the volume average particle size of the aggregated resin particles is so controlled as to fall in a range of from 3 to 10 μm. In this way, heat is easily transmitted to the aggregated resin particles interiorly thereof, wherefore it is possible to obtain highly-durable coalesced resin particles free from grain boundaries. If the volume average particle size of the aggregated resin particles is less than 3 μm, mutual aggregation of the aggregated resin particles will take place easily. In contrast, if the volume average particle size of the aggregated resin particles is greater than 10 μm, it will be difficult to obtain coalesced resin particles free from grain boundaries due to unsatisfactory heat transmission.

Further, in the resin particle aggregation process, it is preferable that the specific heat of the aggregated resin particle slurry is so controlled as to fall in a range of from 4.3 to 8.0 J/g·° C. The specific heat of the aggregated resin particle slurry can be adjusted by changing the ratio in mixture between the aggregated resin particles and the fluid medium constituting the slurry. In this way, too large a rise in heating temperature can be suppressed in the subsequently-performed coalescence process, and besides coalesced resin particles free from grain boundaries are obtainable without causing a decline in productivity. If the specific heat of the aggregated resin particle slurry is less than 4.3 J/g·° C., the concentration of the aggregated resin particles in the slurry is so low that poor productivity will result. In contrast, if the specific heat of the aggregated resin particle slurry is greater than 8.0 J/g·° C., in the subsequently-performed coalescence process of subjecting the aggregated resin particles to coalescence treatment under application of heat and pressure thereby to obtain coalesced resin particles, it becomes difficult to succeed in producing satisfactory coalesced resin particles at the first run. This also leads to poor productivity.

As employed herein, the specific heat of the aggregated resin particle slurry takes on a value determined by calculation in the following manner. With use of a differential scanning calorimeter, the temperature of a sample for measurement is raised to 200° C., is lowered from 200° C. to 0° C. at a temperature lowering rate of 10° C./min, and is raised once again at a temperature elevation rate of 10° C./min so as to obtain a chart indicating a peak exhibited at this time. On the basis of the chart, the specific heat of the aggregated resin particles is derived. After that, under a condition where the specific heat of water is 4.2 J/g·° C., the specific heat of the aggregated resin particle slurry is calculated in accordance with the following formula (1):

$$C1=(C2\times M/100)+(C3\times(100-M)/100) \quad (1)$$

wherein

C1 represents the specific heat of the aggregated resin particle slurry (J/g·° C.);

C2 represents the specific heat of the aggregated resin particles (J/g·° C.);

C3 represents the specific heat of water; and

M represents the proportion in weight (% by weight) of the aggregated resin particles contained in the aggregated resin particle slurry.

Next, the aggregated resin particles contained in the aggregated resin particle slurry are coalesced to obtain coalesced resin particles. This coalescence treatment includes the coalescence process of Step s3, the before-cooling decompression process of Step s4, the cooling process of Step s5, and the decompression process of Step s6.

Figure 3:
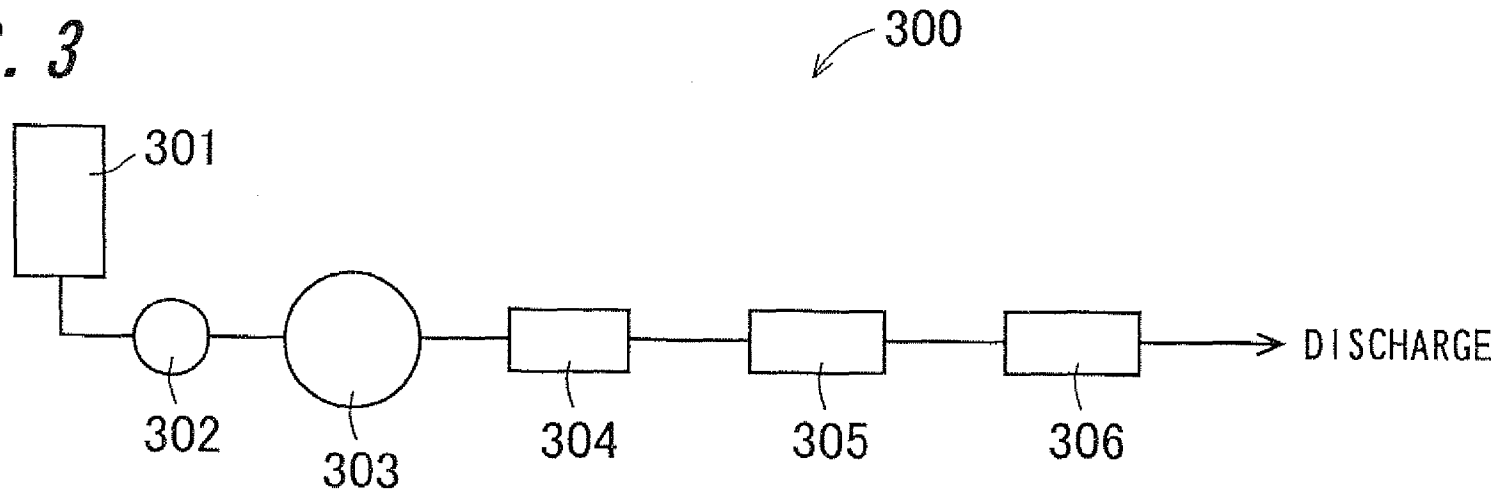
FIG. 3 is a diagram showing the structure of a coalescence treatment device for forming coalesced resin particles from the aggregated resin particles.

FIG. 3 is a diagram showing the structure of a coalescence treatment device 300 for forming coalesced resin particles from the aggregated resin particles. In the present embodiment, the coalescence treatment is carried out by the coalescence treatment device 300. The coalescence treatment device 300 includes a tank 301, a pressurization unit 302, a heater 303, a first decompression module 304, a cooling device 305, and a second decompression module 306 that are coupled to a pipe 307. It is preferable that the pipe 307 is built as a coil-shaped piping.

The tank 301 is a container-like member having an inner space for storing therein a slurry prepared by dispersing the aggregated resin particles in a fluid medium. The pressurization unit 302, which is realized by using a mohno pump, a rotary pump, or the like, applies a predetermined pressure to the aggregated resin particle slurry flowing through the inside of the pipe 307. The heater 303 heats the aggregated resin particle slurry flowing through the inside of the pipe 307 under the pressure applied by the pressurization unit 302 up to a predetermined temperature while maintaining the pressure. The heater 303 is a heating device including a piping disposed along the outer peripheral surface of the pipe 307, for allowing a heat medium (water vapor, for instance) to flow therethrough and a heat medium supply section for feeding the heat medium to the piping. The heat medium supply section is, for example, a boiler.

The aggregated resin particle slurry is pressurized by the pressurization unit 302, is heated by the heater 303, and is flowed through the inside of the pipe 307 under predetermined heating and pressurizing conditions, whereupon the aggregated resin particles are coalesced into coalesced resin particles. The first decompression module 304 performs pressure reduction until a slurry of the coalesced resin particles flowing through the inside of the pipe 307 under application of heat and pressure is subjected to a predetermined pressure. The cooling device 305 cools the coalesced resin particle slurry flowing through the inside of the pipe 307 down to a predetermined temperature. The second decompression module 306 decompresses the coalesced resin particle slurry flowing through the inside of the pipe 307 to an atmospheric pressure level.

[Coalescence Process]

The coalescence process of Step s3 includes a pressurization step of Step s3-(*a*) and a heating step of Step s3-(*b*). The coalescence process is a process of flowing the aggregated resin particle slurry through the inside of the pipe 307 under the predetermined heating and pressurizing conditions with use of the coalescence treatment device 300 so that the aggregated resin particles can be coalesced into coalesced resin particles, thereby to obtain a slurry of the coalesced resin particles.

(Pressurization Step)

The pressurization step of Step s3-(*a*) is a step carried out in the pressurization unit 302 of the coalescence treatment device 300. In the pressurization step, the aggregated resin particle slurry flowing through the inside of the pipe 307 receives application of a pressure of 0.5 to 15 MPa, preferably, a pressure of 0.5 to 5 MPa, and more preferably a pressure of 1 to 2 MPa. In this way, by effecting the compression transportation of the aggregated resin particle slurry under the predetermined pressurizing condition, it is possible to secure a flow rate at which the aggregated resin particle slurry flows without causing settlement of the aggregated resin particles within the pipe 307. If the pressure to be applied is less than 0.5 MPa, the aggregated resin particles constituting the aggregated resin particle slurry flowing through the inside of the pipe 307 will settle out within the pipe 307, which results in a blockage in the pipe 307. In contrast, if the pressure is greater than 15 MPa, excessive energy will be imparted to the aggregated resin particles, with the result that the aggregated resin particles are decomposed into fine particles. This makes it impossible to obtain coalesced resin particles. In addition, since such a pressure level exceeds the pressure capacity set for the subsequently-performed decompression process, the operation itself will be difficult to implement.

(Heating Step)

The heating step of Step s3-(*b*) is a step carried out in the heater 303 of the coalescence treatment device 300. In the heating step, the aggregated resin particle slurry flowing through the inside of the pipe 307 under the pressure applied by the pressurization unit 302 is heated up to a predetermined temperature in a manner maintaining the applied pressure.

The aggregated resin particle slurry subjected to the predetermined pressure in the pressurization step and heated to the predetermined temperature in the heating step is flowed through the inside of the pipe 307 whose internal diameter is set in a range of from 2.0 to 5.0 mm at a flow rate of 100 to 500 mL/min. Moreover, in the coalescence treatment device 300, the distance from the inlet of the pressurization unit 302 to the outlet of the heater 303, expressed differently, the traveling distance covered by the aggregated resin particle slurry flowing through the inside of the pipe 307 under the predetermined heating and pressurizing conditions, is so determined that the time taken for the flowing passage of the aggregated resin particle slurry is approximately 1 minute.

As described hereinabove, the aggregated resin particle slurry is flowed through the inside of the pipe 307 for approximately 1 minute in the predetermined heating and pressurizing conditions. In this way, the aggregated resin particles are coalesced into coalesced resin particles in a grain boundary-free state. Note that, since the coalesced resin particles are obtained as the result of coalescence; that is, unification of the aggregated resin particles under application of heat, it follows that the volume average particle size of the coalesced resin particles is equal to the volume average particle size of the aggregated resin particles.

Thus, coalesced resin particles free from grain boundaries are obtainable in a short period of time. Therefore, in the coalesced resin particles, when used for a toner, occurrence of desorption of a low-melting-point component such as a release agent contained therein can be prevented. Accordingly, it is possible to prevent the low-melting-point component from being exposed at the surface of the coalesced resin particles, and thereby avoid a filming on the surface of a photoreceptor. In consequence, occurrence of image imperfection can be prevented.

Moreover, it is preferable that, in the heating step, the aggregated resin particle slurry is heated at a temperature in a range of ((the softening temperature of the aggregated resin particles)−10)° C. or above and ((the softening temperature of the aggregated resin particles)+80)° C. or below. In this way, even if the slurry has a high concentration of the aggregated resin particles, coalesced resin particles free from grain boundaries are obtainable. If the heating temperature is less than ((the softening temperature of the aggregated resin particles)−10)° C., it becomes impossible to obtain coalesced resin particles free from grain boundaries. In contrast, if the heating temperature is greater than ((the softening temperature of the aggregated resin particles)+80)° C., the low-melting-point component will be desorbed easily.

[Before-Cooling Decompression Process]

The before-cooling decompression process of Step s4 is a process carried out in the first decompression module 304 of the coalescence treatment device 300. In the before-cooling decompression process, the coalesced resin particle slurry flowing through the inside of the pipe 307 in a heat and pressure-applied state is decompressed to a pressure level of higher than an atmospheric pressure but lower than the pressure set for the coalescence process. At this time, the temperature of the coalesced resin particle slurry is lowered with a decrease in pressure. In the before-cooling decompression process, pressure reduction is performed on the coalesced resin particle slurry flowing through the inside of the pipe 307 in a heat and pressure-applied state before it is cooled down to a predetermined temperature in the subsequently-performed cooling process. This makes it possible to suppress occurrence of a turbulent flow within the pipe 307 entailed by development of cavitation, and thereby prevent a broadening in grain size distribution range caused by excessive aggregation of the coalesced resin particles. In consequence, there are obtained coalesced resin particles having a grain size distribution within a narrow range.

In the before-cooling decompression process, it is desirable to perform pressure reduction in a stepwise manner. As the first decompression module 304 for performing pressure reduction in a stepwise manner, a multi-stage decompression device described in WO03/059497 may be adopted for use. The multi-stage decompression device includes: an inlet passageway for admitting the coalesced resin particle slurry in a heat and pressure-applied state into the multi-stage decompression device; an outlet passageway formed so as to communicate with the inlet passageway, for discharging the decompressed coalesced resin particle slurry out of the multi-stage decompression device; and a multi-stage decompression passageway disposed between the inlet passageway and the outlet passageway, which is constructed by coupling a plurality of decompression members together by way of a coupling member.

The coalesced resin particle slurry discharged from the heater 303 in the course of the coalescence process is flowed through the inside of the pipe 307 providing connection between the heater 303 and the inlet passageway of the multi-stage decompression device so as to be introduced into the inlet passageway of the multi-stage decompression device.

In the multi-stage decompression device, for example, a pipe-shaped member may be adopted for use as the decompression member for constituting the multi-stage decompression passageway. Moreover, for example, a ring-shaped sealing member may be adopted for use as the coupling member. The multi-stage decompression passageway is constructed by coupling together a plurality of the pipe-shaped members of different internal diameters by way of the ring-shaped sealing member. For example, the multi-stage decompression passageway is constructed as follows. In a direction from the inlet passageway to the outlet passageway, firstly, a single first pipe-shaped member is coupled with a single second pipe-shaped member whose internal diameter is approximately 2 to 3 times that of the first pipe-shaped member. Next, the second pipe-shaped member is coupled with a single third pipe-shaped member whose internal diameter is approximately 0.2 to 0.5 times that of the second pipe-shaped member. Lastly, the third pipe-shaped member is coupled with 1 to 3 pieces of fourth pipe-shaped members whose internal diameter is approximately 1.3 to 2 times that of the third pipe-shaped member.

Within the multi-stage decompression passageway thereby constructed, the coalesced resin particle slurry in a pressure-applied state is caused to flow. In this way, the coalesced resin particle slurry can be decompressed to a pressure level of higher than an atmospheric pressure but lower than the pressure applied in the coalescence process (preferably, a pressure level in a range of from 30% to 70% of the level of the pressure applied in the coalescence process) without causing bubbling. The multi-stage decompression device may be so designed that the inlet passageway and the outlet passageway have the same dimension in internal diameter, or the outlet passageway is larger in internal diameter than the inlet passageway.

The coalesced resin particle slurry that has undergone pressure reduction in the multi-stage decompression device is discharged out of the multi-stage decompression device through the outlet passageway, and is flowed through the inside of the pipe 307 so as to be introduced into the cooling device 305.

[Cooling Process]

The cooling process of Step s5 is a process carried out in the cooling device 305 of the coalescence treatment device 300. In the cooling process, the coalesced resin particle slurry flowing through the inside of the pipe 307 is cooled down to a predetermined temperature. At this time, the pressure exerted on the coalesced resin particle slurry is reduced with a decrease in temperature. As the cooling device 305, a commonly-used liquid cooling device having a pressure-tight structure may be adopted for use. For example, it is possible to dispose a piping for circulating a coolant around the pipe 307 through which the coalesced resin particle slurry flows. In this case, the coalesced resin particle slurry can be cooled down to approximately 30° C. by the circulation of the coolant.

[Decompression Process]

The decompression process of Step s6 is a process carried out in the second decompression module 306 of the coalescence treatment device 300. In the decompression process, the coalesced resin particle slurry flowing through the inside of the pipe 307 while placed in a cooled-down state in the cooling process is decompressed to an atmospheric pressure. At this time, the temperature of the coalesced resin particle slurry is lowered with a decrease in pressure.

That is, the coalesced resin particle slurry is subjected to step-by-step pressure reduction in the before-cooling decompression process which is conducted prior to the cooling process and in the decompression process which is conducted after the cooling process. In this way, by performing pressure reduction on the coalesced resin particle slurry in a stepwise manner, it is possible to suppress evaporation of the fluid medium from the slurry, and thereby prevent occurrence of fusion and coagulation of the coalesced resin particles within the pipe 307. In consequence, there are obtained coalesced resin particles having a grain size distribution within a narrow range.

It is preferable that the second decompression module 306 is, just like the first decompression module 304 thus far described, constructed of a multi-stage decompression device. Also in this case, the coalesced resin particle slurry is flowed through a multi-stage decompression passageway of the multi-stage decompression device, so that it can be decompressed to an atmospheric pressure without causing bubbling.

[Cleaning Process]

In the cleaning process of Step s7, the coalesced resin particles contained in the coalesced resin particle slurry are subjected to cleaning. The cleaning of the coalesced resin particles is conducted to remove a polymer dispersant, impurities derived from the dispersant, and the like. If the polymer dispersant and impurities remain on the coalesced resin particles, when the coalesced resin particles are used as toner particles, there arises the possibility that the toner particles exhibit unstable charge bearing capability, as well as the possibility that the amount of charge is decreased under the influence of water content in the air.

In order to effect the cleaning of the coalesced resin particles, for example, the coalesced resin particle slurry is agitated with the addition of water, and then a supernatant fluid separated therefrom by means of centrifugal separation or otherwise is removed. It is preferable that the cleaning of the coalesced resin particles is carried out repeatedly until the electrical conductivity of the supernatant fluid obtained by measurement using an electrical conductivity meter or the like device is lowered to 100 μS/cm or less, and more preferably 10 μS/cm or less. This makes it possible to avoid existence of residual polymer dispersant and impurities derived from the dispersant more reliably.

It is preferable that the water used for the cleaning has an electrical conductivity of less than or equal to 20 μS/cm. Such cleaning water can be prepared in accordance with, for example, an activated carbon method, an ion exchanging method, a distillation method, or a reverse osmosis method. Two or more of these methods may be used in combination for the water preparation. The water cleaning of the coalesced resin particles may be carried out in either a batchwise manner or a continuous manner. Although the temperature of the cleaning water is not particularly restricted, preferably it is set in a range of from 10° C. to the glass transition temperature (Tg) of the resin contained in the coalesced resin particles. In a case where the coalesced resin particles contain two or more different resin materials, the lower limit of the aforementioned range "the glass transition temperature (Tg) and below" refers to a temperature of lower than or equal to the glass transition temperature (Tg) of a resin material having the lowest glass transition temperature (Tg) among the two or more different resin materials.

[Separation Process]

In the separation process of Step s8, the coalesced resin particles are separated and collected from the aqueous medium admixture containing the cleansed coalesced resin particles. Although there is no particular limitation to the method of separating the coalesced resin particles from the aqueous medium, exemplary thereof are, for example, filtration, suction filtration, and centrifugal separation.

[Drying Process]

In the drying process of Step s9, the coalesced resin particles that have undergone the cleaning process and the separation process are dried. Although there is no particular limitation to the method of drying the coalesced resin particles, exemplary thereof are, for example, a freeze drying method and a flash drying method.

The coalesced resin particles produced by the manufacturing method of the invention thus far described are, as has already been described, characterized by having a grain size distribution within a narrow range, being free from grain boundaries, and exhibiting high durability. Accordingly, the coalesced resin particles are suitable for use as a toner, a resin spacer for liquid crystal construction, and the like. Moreover, in the case of using the coalesced resin particles produced by the manufacturing method of the invention for a toner, the resultant toner consist of highly-durable toner particles free from grain boundaries, and thus can withstand long-time agitation in a developer tank or the like.

Next, a description will be given below as to a specific example of the case where the coalesced resin particles produced by the manufacturing method of the invention are used as a toner.

The toner according to the invention may be mixed with an external additive capable of serving powder fluidity enhancement, frictional chargeability enhancement, provision of heat resistance, long-time storage stability improvement, cleaning characteristic improvement, photoreceptor-surface abrasion property control, and so forth. As the external additive, the one used customarily in the relevant field may be used, and the examples thereof include fine silica powder, fine titanium oxide powder, and fine alumina powder. It is preferable that, for purposes of hydrophobization, chargeability control, and so forth, such a fine inorganic powder is treated with a treatment agent such as a silicon varnish, modified silicon varnishes of various types, a silicon oil, modified silicon oils of various types, a silane coupling agent, a silane coupling agent containing a functional group, and other organic silicon compounds. The treatment agents may be used each alone, or two or more of them of different types may be used in combination.

It is preferable that the external additive is added in an amount of 1 to 10 parts by weight, and more preferably 5 parts by weight or less, based on 100 parts by weight of the toner particles, in consideration of the amount of charge necessary for the toner, the influence of abrasion exerted on a photoreceptor by the addition of the external additive, the environmental characteristic of the toner, and so forth. It is also preferable that the number average particle size of the primary particles of the external additive falls in a range of from 10 to 500 nm. The use of the external additive having such a particle size contributes to further enhancement of toner fluidity.

In the aforestated manner, the toner is externally added with the external additive on an as needed basis, and this toner can be used in an as-is state as a one-component type developer, or can be used as a two-component developer in admixture with carrier. When used as a one-component type developer, the toner is used alone without having to use carrier. Moreover, when used as a one-component type developer, the toner is electrically charged by friction in a developing sleeve with use of a blade and a fur brush, so that it can be attached onto the sleeve. In this way, the toner becomes conveyable so as to effect image formation.

On the other hand, when used as a two-component developer, the toner of the invention is used along with carrier. As has already been described, the toner of the invention can withstand long-time agitation in a developer tank or the like. That is, the two-component developer containing such a toner succeeds in offering high charging stability for a longer period of time.

As the carrier, heretofore known ones can be used. The examples thereof include: a resin-coated carrier obtained by applying a coating substance to the surface of singular or composite ferrite and carrier core particles made for example of iron, copper, zinc, nickel, cobalt, manganese, or chromium; and a dispersed-in-resin type carrier obtained by dispersing magnetic particles in a resin. Moreover, as the coating substance, heretofore known ones can be used. The examples thereof include polytetrafluoroethylene, a monochlorotrifluoroethylene polymer, polyvinylidene fluoride, a silicone resin, a polyester resin, a metal compound of ditertiary butyl salicylate, a styrenic resin, an acrylic resin, polyacid, polyvinylal, nigrosine, an aminoacrylate resin, a basic dye, a lake product of basic dye, fine silica powder, and fine alumina powder. Further, although there is no particular limitation to the resin used for the dispersed-in-resin type carrier, exemplary thereof are, for example, a styrene acrylic resin, a polyester resin, a fluorinated resin, and a phenol resin. In either case, the selection of resin materials should preferably be made in consideration of the constituents of the toner, and the resin materials may be used each alone, or two or more of them of different types may be used in combination.

It is desired that the carrier has a spherical shape or a flat shape. Though there is no particular limitation, the carrier has a particle size of, preferably from 10 μm to 100 μm, and more preferably, from 20 μm to 50 μm by taking high image quality into consideration. Moreover, the carrier resistivity is preferably $10^8$ Ω·cm or more, and more preferably, $10^{12}$ Ω·cm or more. The resistivity of the carrier is found by introducing the carrier into a container having a sectional area of 0.50 $cm^2$, tapping the container, exerting a load of 1 $kg/cm^2$ on the particles packed in the container, applying a voltage across the load and the bottom surface electrode so as to establish an electric field of 1000 V/cm, and reading an electric current that flows at this moment. If the resistivity is low, an electric charge is poured into the carrier when a bias voltage is applied to a developing sleeve, and the carrier particles tend to attach on the photoreceptor. Besides, the bias voltage easily breaks down.

The intensity of magnetization (maximum magnetization) of the carrier is, preferably, from 10 emu/g to 60 emu/g, and more preferably, from 15 emu/g to 40 emu/g. The intensity of magnetization may vary depending upon the magnetic flux density of the developing roller. Under the conditions of a general magnetic flux density of a developing roller, however, if the intensity of magnetization is smaller than 10 emu/g, no magnetic binding force works and the carrier tends to scatter. Further, if the intensity of magnetization exceeds 60 emu/g, it becomes difficult to maintain the state of not contacting to the image carrier in the non-contact developing in which the ear of the carrier becomes too high. In the contact developing, sweeping stripes may easily appear on the toner image.

There is no particular limitation on the ratio of using the toner and the carrier in the two-component developer, and the ratio can be suitably selected depending upon the toner and the carrier. In the case of the resin-coated carrier (density: 5 to 8 $g/cm^2$) for example, the toner may be used in an amount of 2% by weight to 30% by weight, and preferably 2% by weight to 20% by weight based on the whole amount of the developer. In the two-component developer, further, the coverage of carrier with the toner is preferably 40% by weight to 80% by weight.

Figure 4:
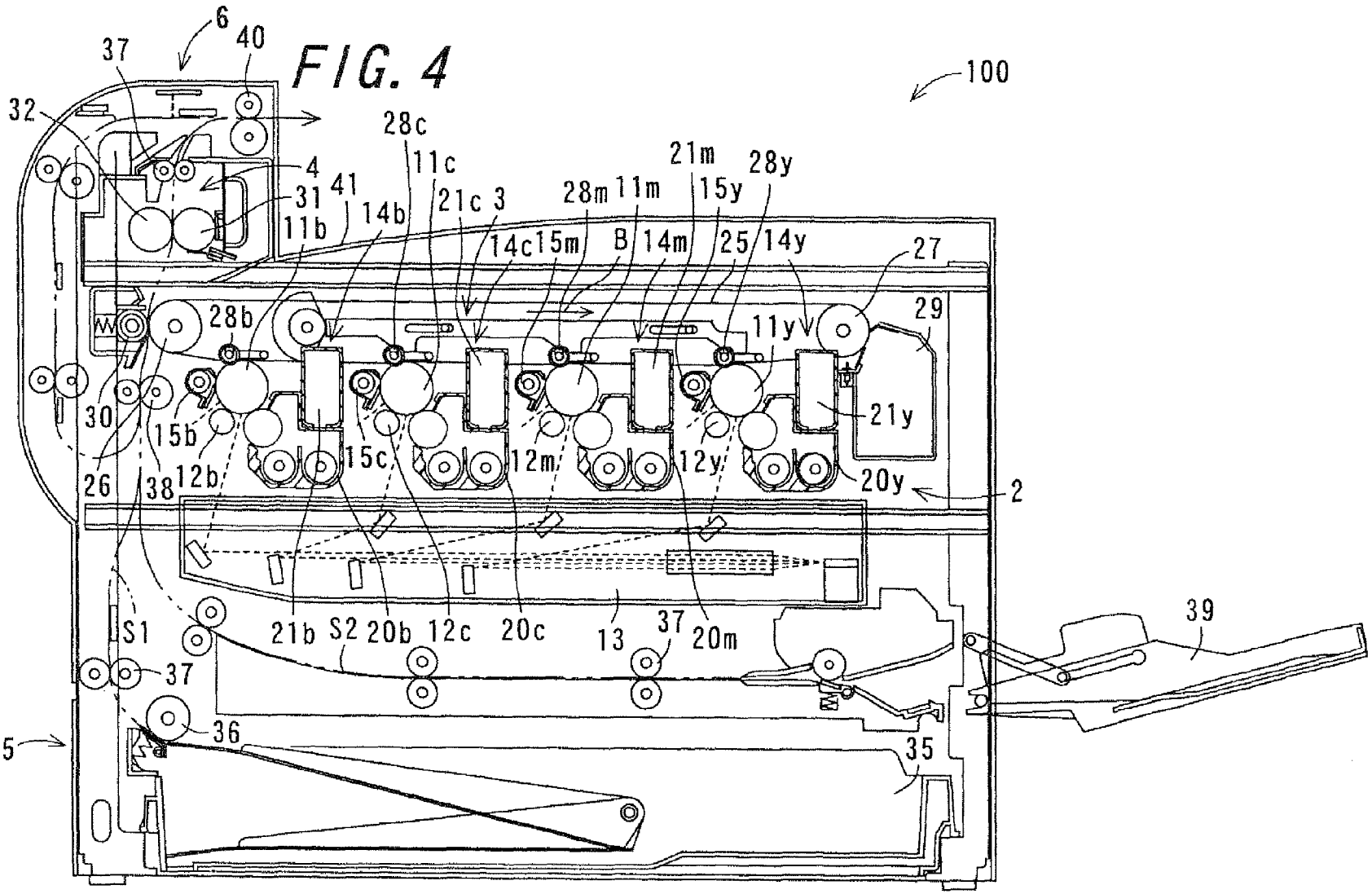
FIG. 4 is a diagram showing the constitution of an image forming apparatus in accordance with one embodiment of the invention.

FIG. 4 is a diagram showing the constitution of an image forming apparatus 100 in accordance with one embodiment of the invention. The image forming apparatus 100 is built as a multifunctional peripheral having a copier function, a printer function, and a facsimile function for forming a full-color or monochromatic image on a recording medium in response to image information transmitted thereto. That is, the image forming apparatus 100 has three printing modes: a copier mode (duplicator mode), a printer mode, and a FAX mode. In this construction, for example, in response to a manipulated input through an operating section (not shown) and receipt of a print job from a personal computer, a portable terminal unit, an information recording-storage medium, and external equipment using a memory device, a printing mode selection is made by a control unit (not shown). The image forming apparatus 100 includes a toner image forming section 2, a transfer section 3, a fixing section 4, a recording medium feeding section 5, and a discharge section 6. In order to deal with image data on different colors: black (b); cyan (c); magenta (m); and yellow (y) included in color image information on an individual basis, the members constituting the toner image forming section 2 and part of the members included in the transfer section 3 are each correspondingly four in number. As employed herein, the four pieces of the constituent members provided separately for different colors are distinguishable according to the alphabetical suffixes indicating their respective colors added to the reference symbols, and collectively they are represented only by the reference symbols.

The toner image forming section 2 comprises a photoreceptor drum 11, a charging section 12, an exposure unit 13, a developing device 14, and a cleaning unit 15. The charging section 12, the developing device 14, and the cleaning unit 15 are arranged about the photoreceptor drum 11 in the order named in a direction in which the photoreceptor drum 11 is rotated. The charging section 12 is arranged vertically below the developing device 14 and the cleaning unit 15.

The photoreceptor drum 11 is supported by a drive portion (not shown) so as to be driven to rotate about an axis thereof, and includes a conductive substrate and a photosensitive layer formed on the surface of the conductive substrate, that are not shown. The conductive substrate can assume various forms, such as a cylinder, a column or a thin sheet. Among them, the cylinder is preferred. The conductive substrate is formed by using a conductive material. The conductive material may be the one that is usually used in this field of art, such as a metal like aluminum, copper, brass, zinc, nickel, stainless steel, chromium, molybdenum, vanadium, indium, titanium, gold or platinum, an alloy of two or more of the above-mentioned metals, a conductive film obtained by forming a conductive layer of one or two or more selected from aluminum, aluminum alloy, tin oxide, gold and indium oxide on a film-like base material such as synthetic resin film, metal film or paper, or a resin composition containing conductive particles and/or a conductive polymer. As the film-like base material used for the conductive film, a synthetic resin film is preferred and a polyester film is particularly preferred. The conductive layer is formed on the conductive film by, preferably, vacuum evaporation or by being applied thereon.

The photosensitive layer is formed by, for example, laminating a charge generating layer containing a charge generating substance and a charge transporting layer containing a charge transporting substance. Here, an undercoat layer is desirably provided between the conductive substrate and the charge generating layer or the charge transporting layer. The undercoat layer covers scars and asperities on the surface of the conductive substrate, and offers such advantages as smoothing the surface of the photosensitive layer, preventing the charging property of the photosensitive layer from deteriorating after the repetitive use, and improving charging characteristics of the photosensitive layer in a low-temperature and/or a low-humidity environment. Further, a photoreceptor surface protection layer may be provided as the uppermost layer to obtain a layered photoreceptor of a three-layer structure having increased durability.

The charge generating layer contains, as a chief component, the charge generating substance that generates the electric charge upon being irradiated with light and may, further, contain a known binder resin, a plasticizer and a sensitizer, as required. The charge generating substance may be the one that is usually used in this field, and there can be used perillene pigments such as perilleneimide and anhydrous perylenic acid; polycyclic quinone pigments such as quinacridone and anthraquinone; phthalocyanine pigments such as metal and metal-free phthalocyanines and halogenated metal-free phthalocyanine; and azo pigments having squariun pigment, azulenium pigment, thiapyrylium pigment, carbazole skeleton, styrylstylbene skeleton, triphenylamine skeleton, dibenzothiophene skeleton, oxadiazole skeleton, fluorenone skeleton, bisstylbene skeleton, distyryloxadiazole skeleton or distyrylcarbazole skeleton.

Among them, the metal-free phthalocyanine pigment, oxotitanylphthalocyanine pigment, bisazo pigment containing a fluorene ring and/or a fluorenone ring, bisazo pigment comprising an aromatic amine and trisazo pigment, have high charge-generating capability and are suited for obtaining a highly sensitive photosensitive layer. The charge generating substances may be used each alone, or two or more of them may be used in combination. Though there is no particular limitation, the charge generating substance can be contained in an amount of, preferably, 5 to 500 parts by weight, and more preferably, 10 to 200 parts by weight based on 100 parts by weight of the binder resin in the charge generating layer. The binder resin used for the charge generating layer may be the one that is usually used in this field of art, such as melamine resin, epoxy resin, silicone resin, polyurethane, acrylic resin, vinyl chloride/vinyl acetate copolymer resin, polycarbonate, phenoxy resin, polyvinyl butyral, polyarylate, polyamide and polyester. The binder resins may be used each alone or, as required, two or more of them may be used in combination.

The charge generating layer can be formed by preparing a coating solution for charge generating layer by dissolving or dispersing the charge generating substance, binder resin and, as required, plasticizer and sensitizer in suitable amounts in a suitable organic solvent capable of dissolving or dispersing these components, and applying the coating solution for charge generating layer onto the surface of the conductive substrate, followed by drying. Though there is no particular limitation, the thus obtained charge generating layer has a thickness of, preferably, 0.05 to 5 μm, and more preferably, 0.1 to 2.5 μm.

The charge transporting layer laminated on the charge generating layer contains the charge transporting substance capable of receiving and transporting the electric charge generated by the charge generating substance and the binder resin for the charge transporting layer as essential components and, further, contains, as required, a known antioxidizing agent, plasticizer, sensitizer and lubricant. The charge transporting substance may be the one that is usually used in this field of art, and there can be used electron-donating materials such as poly-N-vinylcarbazole and derivatives thereof, poly-γ-carbazolylethyl glutamate and derivatives thereof, pyrene/formaldehyde condensate and derivatives thereof, polyvinylpyrene, polyvinylphenanthrene, oxazole derivative, oxadiazole derivative, imidazole derivative, 9-(p-diethylaminostyryl)anthracene, 1,1-bis(4-dibenzylaminophenyl)propane, styrylanthracene, styrylpyrazoline, pyrazoline derivative, phenylhydrazones, hydrazone derivative, triphenylamine compound, tetraphenyldiamine compound, triphenylmethane compound, stylbene compound and azine compound having a 3-methyl-2-benzothiazoline ring; and electron-accepting materials, such as fluorenone derivative, dibenzothiophene derivative, indenothiophene derivative, phenanthrenequinone derivative, indenopyridine derivative, thioxanthone derivative, benzo[c]cinnoline derivative, phenadineoxide derivative, tetracyanoethylene, tetracyanoquinodimethane, bromanil, chloranil and benzoquinone.

The charge transporting substances may be used each alone, or two or more of them may be used in combination. Though there is no particular limitation, the charge transporting substance can be contained in an amount of 10 to 300 parts by weight and, more preferably, 30 to 150 parts by weight based on 100 parts by weight of the binder resin in the charge transporting layer. The binder resin used for the charge transporting layer may be the one that is usually used in this field of art and that is capable of homogeneously dispersing the charge transporting substance therein. There can be used, for example, polycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin or copolymer resin thereof. Among them, it is desired to use polycarbonate containing bisphenol Z as a monomer component (hereinafter referred to as bisphenol Z-type polycarbonate) or a mixture of the bisphenol Z-type polycarbonate and other polycarbonates from the standpoint of film-forming property, wear resistance of the obtained charge transporting layer and electric properties. The binder resins can be used each alone, or two or more of them may be used in combination.

It is preferable that the charge transporting layer contains an antioxidizing agent together with the charge transporting substance and the binder resin for the charge transporting layer. The antioxidizing agent may be the one usually used in this field of art, such as vitamin E, hydroquinone, hindered amine, hindered phenol, paraphenylenediamine, arylalkane and derivatives thereof, organosulfur compound and organophosphor compound. The antioxidizing agents may be used each alone, or two or more of them may be used in combination. Though there is no particular limitation, the content of the antioxidizing agent is 0.01 to 10% by weight and, preferably, 0.05 to 5% by weight based on the total amount of the components constituting the charge transporting layer. The charge transporting layer can be formed by preparing a coating solution for charge transporting layer by dissolving or dispersing the charge transporting substance, binder resin and, as required, antioxidizing agent, plasticizer and sensitizer in suitable amounts in a suitable organic solvent capable of dissolving or dispersing these components, and applying the coating solution for charge transporting layer onto the surface of the charge generating layer, followed by drying.

Though there is no particular limitation, the thus obtained charge transporting layer has a thickness of, preferably, 10 to 50 μm, and more preferably, 15 to 40 μm. Here, the photosensitive layer can also be formed by making the charge generating substance and the charge transporting substance present in one layer. In this case, the kinds and contents of the charge generating substance and of the charge transporting material, the binder resin and other additives may be the same as those of when the charge generating layer and the charge transporting layer are separately formed.

This embodiment employs the photoreceptor drum that forms the organic photosensitive layer by using the charge generating substance and the charge transporting substance. It is, however, also allowable to employ the photoreceptor drum that forms the inorganic photosensitive layer by using silicon and the like.

The charging section 12 faces the photoreceptor drum 11, is arranged along a longitudinal direction of the photoreceptor drum 11 with a gap from the surface of the photoreceptor drum 11 kept, and electrically charges the surface of the photoreceptor drum 11 into a predetermined polarity and potential. As the charging section 12, there can be used a charging brush-type charger, a charger-type charger, a pin array charger or an ion generator. In this embodiment, the charging section 12 is provided being separated away from the surface of the photoreceptor drum 11, to which only, however, the invention is not limited. For example, a charging roller may be used as the charging section 12 and may be so arranged as to come in pressure-contact with the photoreceptor drum. Or, there may be used a charger of the contact charging type, such as a charging brush or a magnetic brush.

The exposure unit 13 is so arranged that light corresponding to the respective pieces of color information from the exposure unit 13 passes through between the charging section 12 and the developing device 14, and falls on the surface of the photoreceptor drum 11. The exposure unit 13 converts the image information into light corresponding to the respective pieces of color information b, c, m and y in the unit, and exposes the surface of the photoreceptor drum 11 charged to uniform potential by the charging means 12 to light corresponding to the respective pieces of color information to form electrostatic latent image on the surface. As the exposure unit 13, there can be used a laser scanning unit having a laser irradiation portion and a plurality of reflectors. There can be, further, used a unit which is suitably combined with an LED (light emitting diode) array, a liquid crystal shutter and a source of light.

Figure 5:
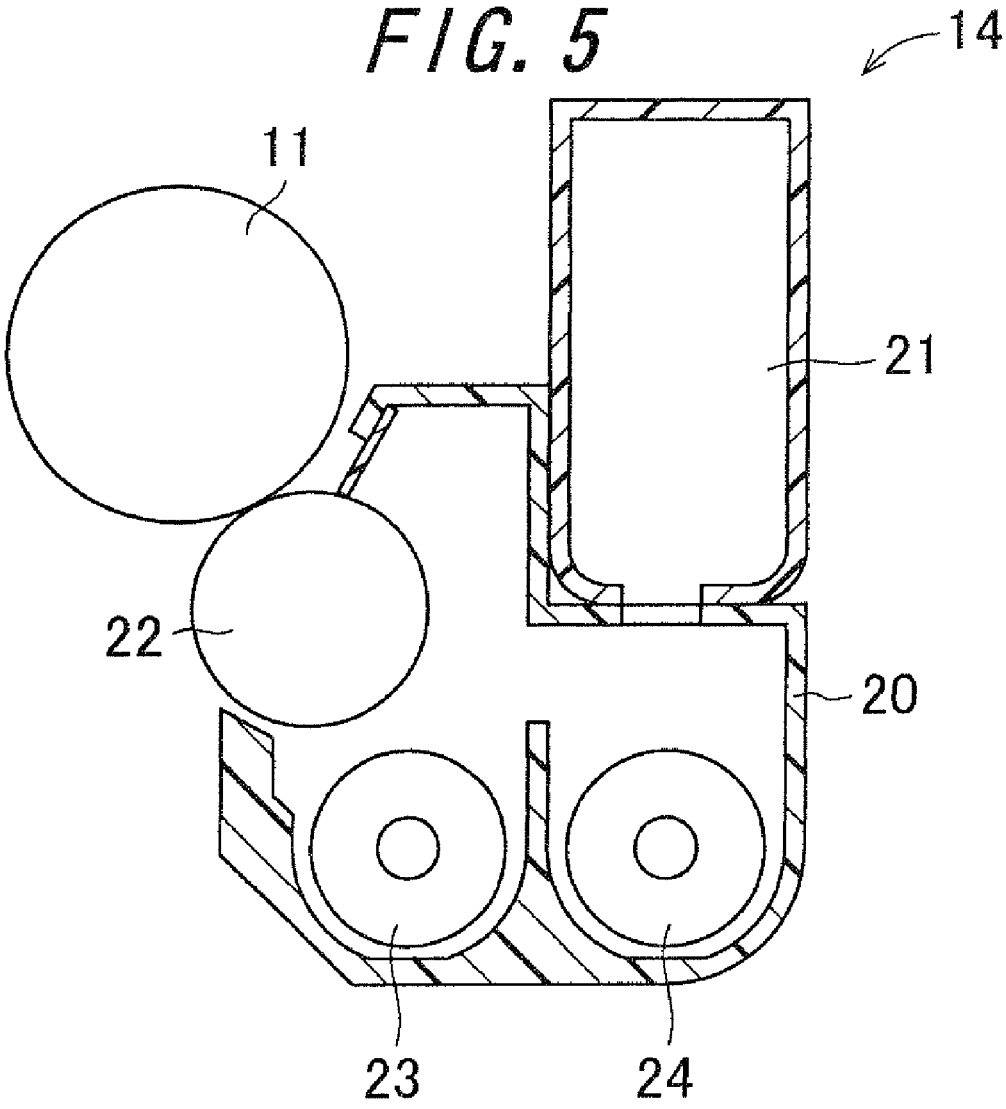
FIG. 5 is a diagram showing the structure of a developing device of the invention.

FIG. 5 is a diagram showing the structure of the developing device 14 of the invention. The developing device 14 performs development with use of a developer or a two-component developer containing the toner of the invention. As has already been described, the toner of the invention is protected from the surface exposure of a low-melting-point component such as a release agent. That is, by virtue of the use of the developer containing such a toner for development, the developing device 14 is capable of protecting the surface of the photoreceptor drum 11 against a filming, wherefore occurrence of image imperfection can be prevented.

The developing device 14 includes a developer tank 20 and a toner hopper 21. The developer tank 20 is disposed face to face with the surface of the photoreceptor drum 11, and is designed as a container-like member for forming a toner image, which is a visible image, by developing an electrostatic latent image formed on the surface of the photoreceptor drum 11 with the supply of the toner. The developer tank 20 accommodates the toner in its inner space. Moreover, within the inner space of the developer tank 20, roller members such as a developing roller 22, a supply roller 23, and an agitating roller 24, or screw members are housed so as to be supported in a freely rotatable manner. The developer tank 20 has an opening formed on a side surface thereof that is opposed to the photoreceptor drum 11. The developing roller 22 is so disposed as to be driven rotatably at a location where it is opposed to the photoreceptor drum 11 through the opening.

The developing roller 22 is a roller-like member for supplying the toner to the electrostatic latent image borne on the surface of the photoreceptor drum 11 at a location where it is brought into pressure-contact with or brought into closest proximity to the photoreceptor drum 11. In order to effect toner supply, on the surface of the developing roller 22 is impressed a potential of a polarity reverse to the polarity of the charge applied to the toner as a development bias voltage. In this way, the toner present on the surface of the developing roller 22 can be supplied smoothly to the electrostatic latent image. Moreover, by making changes to the value of the development bias voltage, it is possible to control the amount of the toner to be supplied to the electrostatic latent image (toner attachment amount).

The supply roller 23 is a roller-like member disposed vis-à-vis the development roller 22 so as to be driven rotatably, for supplying the toner to a region around the developing roller 22. The agitating roller 24 is a roller-like member disposed vis-à-vis the supply roller 23 so as to be driven rotatably, for feeding the toner that has newly been supplied from the toner hopper 21 into the developer tank 20 to a region around the supply roller 23. The toner hopper 21 is so disposed that a toner replenishment port (not shown), which is created in the lower part thereof as seen in a vertical direction, communicates with a toner receiving port (not shown) which is created in the upper part of the developer tank 20 in the vertical direction. In accordance with the condition of consumption of the toner stored in the developer tank 20, the toner hopper 21 effects the replenishment of the toner. Note that the toner hopper 21 does not necessarily have to be provided. In its absence, the replenishment of the toner may be achieved directly from a toner cartridge corresponding to each color.

The cleaning unit 15 acts to, following the completion of toner image transference onto a recording medium, remove residual toner portions remaining on the surface of the photoreceptor drum 11 to clean the surface of the photoreceptor drum 11. As the cleaning unit 15, for example, a platy member such as a cleaning blade is used. Note that, in the image forming apparatus 100 of the invention, basically an organic photoreceptor drum is used for the photoreceptor drum 11. In this case, being composed predominantly of a resin component, the surface of the organic photoreceptor drum is quite susceptible to quality degradation under the influence of a chemical action of ozone resulting from corona discharge effected by the charging device. However, a degraded portion of the surface is worn under a grazing action exerted thereon by the cleaning unit 15, and can thus be removed, though gradually, without fail. Accordingly, the problem of surface quality degradation caused by ozone or the like factor can be solved as a matter of fact, and the charged potential in the charging operation can be maintained with stability for a longer period of time. Although, in the present embodiment, the cleaning unit 15 is provided, the invention is not limited thereto, and therefore the cleaning unit 15 does not necessarily have to be provided.

According to the image forming section 2, the surface of the photoreceptor drum 11 in a state of being uniformly charged by the charging section 12 is irradiated with signal light based on image data emitted from the exposure unit 13 thereby to form an electrostatic latent image thereon. Then, the toner is supplied to the electrostatic latent image from the developing section 14 to form a toner image. After the toner image is transferred onto an intermediate transfer belt 25, residual toner portions remaining on the surface of the photoreceptor drum 11 are removed by the cleaning unit 15. Such a series of toner image forming process steps is carried out repeatedly.

The transfer section 3, which is located above the photoreceptor drum 11, includes the intermediate transfer belt 25, a driving roller 26, a driven roller 27, intermediate transfer rollers 28 (b, c, m, y), a transfer belt cleaning unit 29, and a transfer roller 30. The intermediate transfer belt 25 is an endless belt-shaped member which is supported around the driving roller 26 and the driven roller 27 with tension, for forming a loop-like traveling path. The intermediate transfer belt 25 is driven to turn in a direction indicated by an arrow B. At the time when the intermediate transfer belt 25 passes through the photoreceptor drum 11 while making contact therewith, a transfer bias voltage of a polarity reverse to the polarity of the charge applied to the toner borne on the surface of the photoreceptor drum 11 is impressed by the intermediate transfer roller 28 arranged face to face with the photoreceptor drum 11, with the intermediate transfer belt 25 interposed therebetween. In this way, the toner image formed on the surface of the photoreceptor drum 11 is transferred onto the intermediate transfer belt 25.

In the case of forming a full-color image, the toner images of different colors formed on their respective photoreceptor drums 11 are transferred and overlaid one after another onto the intermediate transfer belt 25, whereupon a full-color toner image is formed. The driving roller 26 is so disposed that it can be driven to rotate about its axis by a driving portion (not shown). As the driving roller 26 is rotatably driven, the intermediate transfer belt 25 is driven to turn in the direction of the arrow B. The driven roller 27 is so disposed that it can be driven to rotate dependently with the rotation of the driving roller 26. The driven roller 27 imparts a tension of certain level to the intermediate transfer belt 25 to prevent it from going slack. The intermediate transfer roller 28 is brought into pressure-contact with the photoreceptor drum 11, with the intermediate transfer belt 25 interposed therebetween, and is so disposed that it can be driven to rotate about its axis by a driving portion (not shown). Being connected with a power source (not shown) for applying the transfer bias voltage in the aforestated manner, the intermediate transfer roller 28 has the capability of transferring the toner image borne on the surface of the photoreceptor drum 11 onto the intermediate transfer belt 25.

The transfer belt cleaning unit 29 is disposed face to face with the driven roller 27, with the intermediate transfer belt 25 interposed therebetween, so as to make contact with the outer peripheral surface of the intermediate transfer belt 25. The toner that attached to the intermediate transfer belt 25 upon contact with the photoreceptor drum 11 is causative of smudges on the back surface of a recording medium. Therefore, the transfer belt cleaning unit 29 removes and collects the toner attachment to the surface of the intermediate transfer belt 25. The transfer roller 30 is brought into pressure-contact with the driving roller 26, with the intermediate transfer belt 25 interposed therebetween, and is so disposed that it can be driven to rotate about its axis by a driving portion (not shown). At a location where the transfer roller 30 and the driving roller 26 are kept in pressure-contact with each other (transfer nip region), the toner image conveyed thereto while being borne by the intermediate transfer belt 25 is transferred onto a recording medium supplied from the recording medium feeding section 5 which will hereafter be described. The recording medium bearing the toner image is supplied to the fixing section 4. According to the transfer section 3, the toner image, which has been transferred from the photoreceptor drum 11 to the intermediate transfer belt 25 at the location where the photoreceptor drum 11 and the intermediate transfer roller 28 are kept in pressure-contact with each other, is conveyed to the transfer nip region as the intermediate transfer belt 25 is driven to turn in the direction of the arrow B. At the transfer nip region, the toner image is transferred onto the recording medium.

The fixing section 4 is disposed downstream of the transfer section 3 with respect to a direction in which the recording medium is conveyed, and includes a fixing roller 31 and a pressure roller 32. The fixing roller 31 is so disposed that it can be driven to rotate by a driving portion (not shown). By the fixing roller 31, the toner constituting a yet-to-be-fixed toner image borne on the recording medium is subjected to heat, so that it can be fused. A heating portion (not shown) is disposed in the fixing roller 31 interiorly thereof. The heating portion applies heat to the fixing roller 31 in such a manner that the temperature of the surface of the fixing roller 31 can be raised to a predetermined temperature (heating temperature). As the heating portion, for example, a heater, a halogen lamp, or the like can be used. The heating portion is controlled by a fixing condition control portion which will hereafter be described.

In the vicinity of the surface of the fixing roller 31 is disposed a temperature detection sensor for detecting the surface temperature of the fixing roller 31. The result of detection produced by the temperature detection sensor is written to a memory portion of the control unit that will hereafter be described. The pressure roller 32 is so disposed as to be brought into pressure-contact with the fixing roller 31, and is so supported that it can be driven to rotate dependently with the rotation of the fixing roller 31. The pressure roller 32 fixes a toner in fused state onto a recording medium in cooperation with the fixing roller 31. At this time, the pressure roller 32 assists in the fixation of the toner image onto the recording medium by pressing the toner against the recording medium. A location where the fixing roller 31 and the pressure roller 32 are kept in pressure-contact with each other is defined as a fixation nip region. According to the fixing section 4, when the recording medium on which the toner image has been transferred by the transfer section 3 passes through the fixation nip region while being held between the fixing roller 31 and the pressure roller 32, the toner image is pressed against the recording medium under the application of heat. In this way, the toner image is fixed onto the recording medium, whereupon image formation is achieved.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium to the registration rollers 38.

The registration rollers 38 are a pair of roller members disposed in pressure-contact with each other, and feed to the transfer nip region the recording medium fed from the conveying rollers 37 in synchronization with the conveyance of the toner image carried on the intermediate transfer belt 25 to the transfer nip region. The manual paper feed tray 39 is a device for storing recording mediums which are different from the recording mediums stored in the automatic paper feed tray 35 and may have any size and which are to be taken into the image forming apparatus 100. The recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image carried on the intermediate transfer belt 25 to the transfer nip region.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper portion in the inner space of the image forming apparatus 100, and includes a memory portion, a computing portion, and a control portion. The memory portion of the control unit is inputted, for example, with various setting values via an operation panel (not shown) disposed to the upper surface of the image forming apparatus 100, detection result from sensors (not shown), etc. disposed at each portion in the image forming apparatus 100, and image information from external apparatuses. Further, programs for executing operations of various functional elements are written in the memory portion. The various functional elements are, for example, a recording medium judging section, an attachment amount control section, the fixing condition control section, etc. As the memory portion, those customarily used in this field can be used and examples thereof include a read only memory (ROM), a random access memory (RAM), and a hard disk drive (HDD).

As the external apparatuses, electric and electronic apparatuses capable of forming or acquiring image information and capable of being electrically connected with the image forming apparatus 100 can be used, and examples thereof include a computer, a digital camera, a television set, a video recorder, a DVD (Digital Versatile Disc) recorder, HDDVD (High-Definition Digital Versatile Disc), a Blu-ray disk recorder, a facsimile unit, and a portable terminal apparatus. The computing portion takes out various data written into the memory portion (image forming instruction, detection result, image formation, etc.) and programs for various functional elements to conduct various judgments. The control portion delivers control signals to the relevant apparatus in accordance with the result of judgment of the calculation section to conduct operation control. The control portion and the computing portion include a processing circuit provided by a microcomputer, a microprocessor, etc. provided with a central processing unit (CPU). The control unit includes a main power source together with the processing circuit described above, and the power source supplies power not only to the control unit but also to each of the devices in the inside of the image forming apparatus 100.

By effecting image formation with the image forming apparatus 100 provided with the developing device 14 for performing development with use of a developer containing the toner of the invention, it is possible to obtain high-quality images with stability for a longer period of time.

EXAMPLES

Hereinafter, the invention will be described in detail with the implementation of Examples and Comparative examples. In Examples and Comparative examples, the measurement of various physical property values was conducted as follows.

<Softening Temperature of Resin ($T_{1/2}$)>

A Theological characteristics evaluation apparatus (trade name: Flow Tester CFT-500C, manufactured by Shimadzu Corporation) was used for measurement. After a sample of 1 g was inserted in a cylinder, a load of 10 kgf/cm$^2$ (0.980665 MPa) was applied to extrude the sample from a die while applying heat at a temperature elevation rate of 6° C. per minute (6° C./min). Then, a temperature at which half of the sample was flowed out of the die was obtained as the softening temperature. The die in use is 1 mm in bore diameter and 1 mm in length.

(Volume Average Particle Size of Aggregated Resin Particles)

A sample for measurement was prepared by adding 20 mg of aggregated resin particles and 1 ml of sodium alkyl ether sulfate to 50 ml of an electrolyte (trade name: ISOTON-II, manufactured by Beckman Coulter Inc.), and dispersing the mixture by using an ultrasonic wave dispersion device (trade name: UH-50, manufactured by STM Corporation) at an ultrasonic wave frequency of 20 kHz for 3 minutes. By using a particle size distribution-measuring device (trade name: Multisizer III, manufactured by Beckman Coulter Inc.), the sample for measurement was measured under the conditions of an aperture diameter of 100 μm and number of particles to be measured: 50,000 counts. A volume average particle size of aggregated resin particles was found from the volume particle size distribution of the sample particles.

<Specific Heat of Aggregated Resin Particles>

A differential scanning calorimeter (trade name: DSC 220, manufactured by Seiko Instruments & Electronics Ltd.) was used for measurement. The temperature of a sample of the aggregated resin particles was raised to 200° C. and then lowered from 200° C. to 0° C. at a temperature lowering rate of 10° C./min. The sample, now kept in a cooled state, was heated once again at a temperature elevation rate of 10° C./min so as to obtain a chart indicating a peak exhibited at this time. On the basis of the chart, the specific heat of the aggregated resin particles was derived. After that, under a condition where the specific heat of water is 4.2 J/g·° C., the specific heat of the aggregated resin particle slurry is calculated in accordance with the following formula (1):

$$C1=(C2\times M/100)+(C3\times(100-M)/100) \quad (1)$$

wherein

C1 represents the specific heat of the aggregated presin particle slurry (J/g·° C.);

C2 represents the specific heat of the aggregated resin particles (J/g·° C.);

C3 represents the specific heat of water; and

M represents the proportion in weight (% by weight) of the aggregated resin particles contained in the aggregated resin particle slurry.

<Production of Toner Examples and Comparative Examples>

Example 1

[Fine Resin Particle Preparation Process]

(Melt-Kneading Step)

There were prepared: 79 parts by weight of polyester serving as a binder resin (glass transition temperature (Tg): 63.8° C., softening temperature ($T_{1/2}$): 120° C., Mw value: 82000); 16 parts by weight of a master batch (C.I. Pigment Blue 15:3 is contained in an amount of 40% by weight); 4 parts by weight of paraffin wax serving as a release agent (trade name: HNP 11, manufactured by Nippon Seiro Co., Ltd.) having a melting point of 68° C.; and 1 part by weight of metal alkyl salicylate serving as a charge control agent (trade name: BONTRON E-84, manufactured by Orient Chemical Industries, Ltd.). These constituent components were mixed for 10 minutes by Henschel Mixer. After that, the resultant admixture was melt-kneaded by a twin-screw extruder (trade name: PCM 65, manufactured by Ikegai, Ltd.) In this way, a melt-kneaded product 1 was obtained.

(Coarsely Pulverizing Step)

900 parts by weight of the melt-kneaded product 1 obtained in the melt-kneading step was put in PUC Colloid Mill (trade name) manufactured by Nippon Ball Valve Co., Ltd., along with 120 parts by weight of a dispersant (trade name: NEWCOL 10N, manufactured by Nippon Nyukazai Co., Ltd.) having a solid content concentration of 25.8%, 2 parts by weight of a moistening agent (trade name: AIR-ROLL, manufactured by TOHO Chemical Industry Co., Ltd.) having a solid content concentration of 72.0%, and 1978 parts by weight of ion-exchanged water. Then, these constituent components was wet-milled. In this way, a coarse powder slurry 1 of the melt-kneaded product was obtained.

(Pulverization Step, Fine Resin Particle Cooling Step, and Fine Resin Particle Decompression Step)

Next, with use of High-pressure Homogenizer nano3000, the melt-kneaded product contained in the coarse powder slurry 1 of the melt-kneaded product was pulverized into fine particles under the following pulverization conditions, and the resultant fine particles were subjected to cooling and pressure reduction. In this way, a fine resin particle slurry 1 was obtained.

<Pulverization Conditions>

Pressure: 167 MPa

Preset temperature: 190° C.

Nozzle diameter: 0.07 mm

[Resin Particle Aggregation Process]

600 parts by weight of the fine resin particle slurry 1 obtained in the fine resin particle preparation process was added with 22.2 parts by weight of a flocculating agent (first-grade sodium chloride, manufactured by Wako Pure Chemical Industries, Ltd.) Then, with use of CLEARMIX W-motion, fine resin particles contained in the fine resin particle slurry 1 was caused to clump together under the following aggregation conditions. In this way, an aqueous dispersion of aggregated resin particles 1 (specific heat: 4.8 J/g·° C.) was obtained. The aggregated resin particles 1 contained in the thereby obtained aqueous dispersion were found to have a volume average particle size of 5.0 μm.

<Aggregation Conditions>

Target temperature to be reached: 62° C.

Temperature elevation rate: 1.5° C./min

Revs (Rotor/Stator): 18000 rpm/0 rpm

Duration of time that preset temperature is being maintained: 10 minutes

[Coalescence Process]

500 parts by weight of the aqueous dispersion of the aggregated resin particles 1 was added with 5 parts by weight of a dispersant (trade name: NEWCOL 10N, manufactured by Nippon Nyukazai Co., Ltd.) having a solid content concentration of 25.8%. The resultant admixture was pressurized to 0.5 MPa by a mohno pump serving as a pressurization device (trade name: NEMO® Pump, manufactured by HEISHIN Ltd.) Then, in the pressure-applied state, it was heated up to 130 (the softening temperature of the aggregated resin particles+10)° C., and passed flowingly through the inside of a coil-shaped piping having a tube internal diameter of 3.0 mm for 1 minute at a flow rate of 200 mL/min. In this way, an aqueous dispersion of coalesced resin particles 1 was obtained.

[Before-Cooling Decompression Process]

With use of a multi-stage decompression device constructed by arranging pipe-shaped decompression members of different internal diameters: 0.5 mm, 1.5 mm, 0.75 mm, 1.5 mm, and 1.0 mm, respectively, one after another in the order named from the side of an inlet, the aqueous dispersion of the coalesced resin particles 1 was flowed through the inside of the pipe-shaped decompression members so as to be decompressed to 0.3 MPa. At this time, the temperature was found to stand at 120° C.

[Cooling Process]

With use of Liebig condenser equipped with pressure-tight piping as internal piping, the aqueous dispersion of the coalesced resin particles 1 that was decompressed to 0.3 MPa was flowed through the inside of the internal piping so as to be cooled down to 30° C. At this time, the pressure was found to stand at 0.3 MPa.

[Decompression Process]

With use of a multi-stage decompression device constructed by arranging pipe-shaped decompression members that are 1.0 mm in internal diameter one after another from the side of an inlet, the aqueous dispersion of the coalesced resin particles 1 was flowed through the inside of the pipe-shaped decompression members so as to be decompressed to an atmospheric pressure. At this time, the temperature was found to stand at 28° C.

The aqueous dispersion of the coalesced resin particles 1 thereby obtained was washed thoroughly with ion-exchanged water and then dried. In this way, toner particles 1 consisting of the coalesced resin particles were obtained. The toner particles 1 were defined as a toner 1 according to Example 1.

Example 2

A toner 2 of Example 2 was produced basically in the same manner as in Example 1, except that the level of pressure for the operation in the coalescence process was set at 15.0 MPa.

Example 3

A toner 3 of Example 3 was produced basically in the same manner as in Example 1, except that the level of pressure for the operation in the coalescence process was set at 5.0 MPa.

Example 4

A toner 4 of Example 4 was produced basically in the same manner as in Example 1, except that the level of pressure for the operation in the coalescence process was set at 1.0 MPa.

Example 5

A toner 5 of Example 5 was produced basically in the same manner as in Example 1, except that the level of pressure for the operation in the coalescence process was set at 2.0 MPa.

Example 6

A toner 6 of Example 6 was produced basically in the same manner as in Example 1, except that the level of pressure for the operation in the coalescence process was set at 1.5 MPa.

Example 7

A toner 7 of Example 7 was produced basically in the same manner as in Example 1, except for the use of an aqueous dispersion of aggregated resin particles 6 (specific heat: 4.8 J/g·° C., volume average particle size: 2.8 μm) obtained under the condition where the target temperature to be reached in the resin particle aggregation process is set at 56° C.

Example 8

A toner 8 of Example 8 was produced basically in the same manner as in Example 1, except for the use of an aqueous dispersion of aggregated resin particles 7 (specific heat: 4.8 J/g·° C., volume average particle size: 3.0 μm) obtained under the condition where the target temperature to be reached in the resin particle aggregation process is set at 57° C.

Example 9

A toner 9 of Example 9 was produced basically in the same manner as in Example 1, except for the use of an aqueous dispersion of aggregated resin particles 8 (specific heat: 4.8 J/g·° C., volume average particle size: 7.0 μm) obtained under the condition where the target temperature to be reached in the resin particle aggregation process is set at 67° C.

Example 10

A toner 10 of Example 10 was produced basically in the same manner as in Example 1, except for the use of an aqueous dispersion of aggregated resin particles 9 (specific heat: 4.8 J/g·° C., volume average particle size: 7.2 μm) obtained under the condition where the target temperature to be reached in the resin particle aggregation process is set at 68° C.

Example 11

A toner 11 of Example 11 was produced basically in the same manner as in Example 1, except that the heating temperature in the coalescence process was set at 105 (the softening temperature of the aggregated resin particles−15)° C.

Example 12

A toner 12 of Example 12 was produced basically in the same manner as in Example 1, except that the heating temperature in the coalescence process was set at 110 (the softening temperature of the aggregated resin particles−10)° C.

Example 13

A toner 13 of Example 13 was produced basically in the same manner as in Example 1, except that the heating temperature in the coalescence process was set at 200 (the softening temperature of the aggregated resin particles+80)° C.

Example 14

A toner 14 of Example 14 was produced basically in the same manner as in Example 1, except that the heating temperature in the coalescence process was set at 205 (the softening temperature of the aggregated resin particles+85)° C.

Example 15

A toner 15 of Example 15 was produced basically in the same manner as in Example 4, except for the use of an aqueous dispersion of aggregated resin particles having a specific heat of 4.25 J/g·° C.

Example 16

A toner 16 of Example 16 was produced basically in the same manner as in Example 4, except for the use of an aqueous dispersion of aggregated resin particles having a specific heat of 4.30 J/g·° C.

Example 17

A toner 17 of Example 17 was produced basically in the same manner as in Example 4, except for the use of an aqueous dispersion of aggregated resin particles having a specific heat of 8.0 J/g·° C.

Example 18

A toner 18 of Example 18 was produced basically in the same manner as in Example 4, except for the use of an aqueous dispersion of aggregated resin particles having a specific heat of 8.05 J/g·° C.

Comparative Example 1

A toner H1 of Comparative example 1 was produced basically in the same manner as in Example 1, except that the level of pressure for the operation in the coalescence process was set at 0.45 MPa.

Comparative Example 2

A toner H2 of Comparative example 2 was produced basically in the same manner as in Example 1, except that the level of pressure for the operation in the coalescence process was set at 15.05 MPa.

Comparative Example 3

A toner H3 of Comparative example 3 was produced basically in the same manner as in Example 1, except that, in the coalescence process, agitation was carried out under conditions of a duration of 6 hours and a temperature of 80° C. by using an emulsification machine of single motion type (trade name: CLEARMIX, manufactured by N Technique Co., Ltd.)

<Evaluation>

The toners of Examples 1 through 18 and Comparative examples 1 through 3 were evaluated for the following evaluative points. The results of evaluation are listed in Table 1.

[Coalescence Time Duration]

Out of Examples and Comparative examples, the one that required less than 5 minutes for the completion of the coalescence process under the corresponding conditions was rated as "Good". On the other hand, the one that required 5 minutes or more for the completion of the coalescence process, or the one that could not be formed into a toner successfully because of a failure in the operation under the corresponding conditions was rated as "Failure".

[Toner Particle Size Distribution]

Out of Examples and Comparative examples, the one in which the ratio in change of the coefficient of variation in volume average particle size of the toner obtained under the corresponding conditions to the coefficient of variation in volume average particle size of the aggregated resin particles is less than 5% was rated as "Good". The one in which the ratio in change is greater than or equal to 5% but less than 10% was rated as "Middling". The one in which the ratio in change is greater than 10% was rated as "Failure".

[Toner Coalescability]

2.0 g of the toner, 1 ml of sodium alkyl ether sulfate, and 50 ml of pure water were put into a 100 ml-beaker and subjected to thorough agitation to prepare a dispersion liquid. The dispersion liquid was treated with an ultrasonic homogenizer (manufactured by NISSEI) at a power output of 50 μA for 5 minutes for further dispersion. The dispersion liquid was left standing at rest for 6 hours, and then a supernatant fluid was removed. After that, with the addition of 50 ml of pure water, the dispersion liquid was agitated for 5 minutes by a magnetic stirrer, and whereafter subjected to suction filtration with use of a membrane filter (1 μm in bore diameter). The cleansed object remaining on the membrane filter was vacuum-dried in a desiccator containing silica gel substantially all through the night.

On the surface of the toner particles that underwent surface cleaning in that way, there was formed a metal film (Au film having a film thickness of 0.5 μm) by means of sputter deposition. Then, 200 to 300 pieces of the particles taken in a random fashion from the thereby obtained metal film-coated toner particle sample were photographed by a scanning electron microscope (trade name: S-570, manufactured by Hitachi, Ltd.) under conditions of an acceleration voltage of 5 kV and a magnification of 1000 times. The data of the electron photomicrograph was subjected to image analysis with use of an image analysis software (trade name: A-ZO-KUN, manufactured by Asahi Kasei Engineering Corporation). The particle analysis parameters of the image analysis software called "A-ZO-KUN" are as follows: small graphic component removal area: 100 pixels, reduction-separation: 1 time; small graphic component: 1; number of times: 10, denoising filter: absent, shading: absent, a unit of result representation: μm. On the basis of the maximum length (MXLNG), perimeter (PERI), and graphic area (AREA) as to the particles obtained from the result of analysis, a shape factor SF2 was derived in accordance with the following formula (2).

$$SF2=\{(\mathrm{PERI})^2/\mathrm{AREA}\}\times(100/4\pi) \quad (2)$$

Out of Examples and Comparative examples, the one that possesses SF2 of greater than or equal to 100 but less than 115 was rated as "Good". The one that possesses SF2 of greater than or equal to 115 but less than 130 was rated as "Middling". The one that possesses SF2 of greater than or equal to 130 was rated as "Failure". Note that a symbol "-" shown in Table 1 represents that the evaluation ended in failure due to unsuccessful toner formation.

TABLE 1

| | Coalescence time duration | Toner particle size distribution | Toner coalescability |
|---|---|---|---|
| Example 1 | Good | Middling | Good |
| Example 2 | Good | Middling | Good |
| Example 3 | Good | Middling | Good |
| Example 4 | Good | Good | Good |
| Example 5 | Good | Good | Good |
| Example 6 | Good | Good | Good |
| Example 7 | Good | Middling | Good |
| Example 8 | Good | Good | Good |
| Example 9 | Good | Good | Good |
| Example 10 | Good | Good | Middling |
| Example 11 | Good | Good | Middling |
| Example 12 | Good | Good | Good |
| Example 13 | Good | Good | Good |
| Example 14 | Good | Middling | Good |
| Example 15 | Good | Middling | Good |
| Example 16 | Good | Good | Good |
| Example 17 | Good | Good | Good |
| Example 18 | Good | Good | Middling |
| Comparative example 1 | Failure | — | — |
| Comparative example 2 | Good | Failure | — |
| Comparative example 3 | Failure | Middling | Good |

As will be apparent from Table 1, the toners of Examples 1 through 18 are each of coalesced resin particles obtained by achieving coalescence in a short period of time while preventing development of grain boundaries. Note that the toner of Comparative example 3, in which toner particles were produced by a conventional coalescence method based on agitation and application of heat, required a longer period of time for achieving coalescence in a grain boundary-free state.

Next, the following evaluation was conducted in respect of two-component developers containing the toners of Examples and Comparative examples, respectively. The results of evaluation are listed in Table 2.

(Manufacturing of Two-Component Developer)

A ferrite core carrier having a volume average particle size of 45 μm was used as the carrier. The toner and the carrier were mixed together for 20 minutes by using a V-type mixer (trade name: V-5, manufactured by Tokuju Corporation) in a manner that the coverage of the carrier with toner was 60% in Examples 1 to 18 and in Comparative examples 1 to 3 in order to manufacture the two-component developer.

<Evaluation>

[Image Reproducibility]

Each of the two-component developers containing the toners of Examples and Comparative examples, respectively, was charged in a copying machine (type MX-7001N) manufactured by Sharp Corporation. Under the condition where a half-tone image which is 0.3 in image density and 5 mm in diameter can be duplicated at image density in a range of from 0.3 to 0.5, a document bearing a thin line-made original image, the line width of which is exactly 100 μm, was copied on a recording medium. The resultant copy image was used as a measurement sample. The image density refers to optical reflection density measured by a reflection densitometer (trade name: RD-918, manufactured by Macbeth Corporation).

The thin lines formed in the measurement sample were magnified at a magnification of 100 times by a particle analyzer (trade name: LUZEX 450, manufactured by NIRECO CORPORATION). On the basis of the monitored image showing the 100 times-magnified thin lines, the line width of the thin lines formed in the copy image was measured by an indicator.

The thin lines formed in the copy image have irregularities and the line width thereof varies according to measurement positions. Therefore, line width measurement was conducted at a plurality of measurement positions and a mean value of the line width was determined by calculation. The line width corresponding to the mean value was defined as the line width of the thin lines formed in the copy image. At this time, the line width of less than 100 μm resulting for example from unsuccessful transfer was not counted; that is, the value of the line width of less than 100 μm was not used for the calculation of the line-width mean value. Then, the line width of the thin lines formed in the copy image was divided by 100 μm which is the line width of the thin lines of the original image. A value derived by multiplying the value obtained by the division by 100 was defined as the value of thin-line reproducibility. The more the thin-line reproducibility value is close to 100, the better the thin-line reproducibility becomes. Good thin-line reproducibility leads to excellent image reproducibility and excellent resolution property. That is, the sample that possesses satisfactory thin-line reproducibility proved that it offered satisfactory image reproducibility.

The measurement samples were evaluated as to image reproducibility based on the following evaluative criteria.

Good: thin-line reproducibility value is greater than or equal to 100 but less than 105

Middling: thin-line reproducibility value is greater than or equal to 105 but less than 110

Failure: thin-line reproducibility value is greater than or equal to 110

[Long-Term Image Reproducibility]

Each of the two-component developers containing the toners of Examples and Comparative examples, respectively, was charged in a copying machine (type MX-7001N) manufactured by Sharp Corporation. Following the completion of consecutive production of 10000 sheets of copies, image evaluation was made in the same manner as in the image reproducibility evaluation.

[Comprehensive Evaluation]

The results of evaluation as to various evaluative points thus far described are expressed in the form of score (Good: 2 points; Middling: 1 point; Failure: 0 point). The criteria for the comprehensive evaluation are as follows.

Excellent: a score of 7 points or more

Good: a score of 6 points

Middling: a score of 5 points

Failure: a score of 4 points or less, or rated as "Eailure" in one or more evaluative points

TABLE 2

| | Image reproducibility | Long-term image reproducibility | Comprehensive evaluation |
|---|---|---|---|
| Example 1 | Good | Good | Excellent |
| Example 2 | Good | Good | Excellent |
| Example 3 | Good | Good | Excellent |
| Example 4 | Good | Good | Excellent |
| Example 5 | Good | Good | Excellent |
| Example 6 | Good | Good | Excellent |
| Example 7 | Good | Middling | Excellent |
| Example 8 | Good | Good | Excellent |
| Example 9 | Good | Good | Excellent |
| Example 10 | Good | Good | Excellent |
| Example 11 | Good | Good | Excellent |
| Example 12 | Good | Good | Excellent |
| Example 13 | Good | Good | Excellent |
| Example 14 | Good | Good | Excellent |
| Example 15 | Good | Good | Excellent |
| Example 16 | Good | Good | Excellent |
| Example 17 | Good | Good | Excellent |
| Example 18 | Good | Good | Excellent |
| Comparative example 1 | — | — | Failure |
| Comparative example 2 | Good | Failure | Failure |
| Comparative example 3 | Good | Good | Excellent |

As will be apparent from Table 2, in the case of using the two-component developer containing any of the toners of Examples 1 through 18, it is possible to attain excellent image reproducibility for a longer period of time.

<Production of Resin Spacer for Liquid-Crystal Construction by Way of Example and Comparative Examples>

Example 19

[Fine Resin Particle Preparation Process]

(Coarsely Pulverizing Step)

900 parts by weight of polyester serving as a binder resin (glass transition temperature (Tg): 63.8° C., softening temperature ($T_{1/2}$): 120° C., Mw value: 82000) was put in PUC Colloid Mill (trade name) manufactured by Nippon Ball Valve Co., Ltd., along with 120 parts by weight of a dispersant (trade name: NEWCOL 10N, manufactured by Nippon Nyukazai Co., Ltd.) having a solid content concentration of 25.8%, 2 parts by weight of a moistening agent (trade name: AIRROLL, manufactured by TOHO Chemical Industry Co., Ltd.) having a solid content concentration of 72.0%, and 1978 parts by weight of ion-exchanged water, and these constituent components were wet-milled. In this way, a coarse powder slurry 19 was obtained.

(Pulverization Step, Fine Resin Particle Cooling Step, and Fine Resin Particle Decompression Step)

Next, with use of High-pressure Homogenizer nano3000, the resin contained in the coarse powder slurry 19 was pulverized into fine particles under the following pulverization conditions, and the resultant fine particles were subjected to cooling and pressure reduction. In this way, a fine resin particle slurry 19 was obtained.

<Pulverization Conditions>

Pressure: 210 MPa

Preset temperature: 190° C.

Nozzle diameter: 0.07 mm

[Resin Particle Aggregation Process]

600 parts by weight of the fine resin particle slurry 19 obtained in the fine resin particle preparation process was added with 22.2 parts by weight of a flocculating agent (first-grade sodium chloride, manufactured by Wako Pure Chemical Industries, Ltd.) Then, with use of CLEARMIX W-motion, the fine resin particles contained in the fine resin particle slurry 19 were caused to clump together under the following aggregation conditions. In this way, an aqueous dispersion of aggregated resin particles 19 (specific heat: 5.0 J/g·° C.) was prepared. The aggregated resin particles 19 contained in the thereby obtained aqueous dispersion were found to have a volume average particle size of 5.0 μm.

<Aggregation Conditions>

Target temperature to be reached: 62° C.

Temperature elevation rate: 1.5° C./min

Revs (Rotor/Stator): 18000 rpm/0 rpm

Duration of time that preset temperature is being maintained: 10 minutes

[Coalescence Process]

500 parts by weight of the aqueous dispersion of the aggregated resin particles 19 was added with 5 parts by weight of a dispersant (manufactured by Nippon Nyukazai Co., Ltd. under the trade name of NEWCOL 10N) having a solid content concentration of 25.8%. The resultant admixture was pressurized to 1.5 MPa by a mohno pump serving as a pressurization device (trade name: NEMO® Pump, manufactured by HEISHIN Ltd.) Then, in the pressure-applied state, it was heated up to 130 (the softening temperature of the aggregated resin particles+10)° C., and flowed through the inside of a coil-shaped piping having a tube internal diameter of 3.0 mm for 1 minute at a flow rate of 200 mL/min. In this way, an aqueous dispersion of coalesced resin particles 19 was obtained.

[Before-Cooling Decompression Process]

With use of a multi-stage decompression device constructed by arranging pipe-shaped decompression members of different internal diameters: 0.5 mm, 1.5 mm, 0.75 mm, 1.5 mm, and 1.0 mm, respectively, one after another in the order named from the side of an inlet, the aqueous dispersion of the coalesced resin particles 19 was flowed through the inside of the pipe-shaped decompression members so as to be decompressed to 1 MPa. At this time, the temperature was found to stand at 120° C.

[Cooling Process]

With use of Liebig condenser equipped with pressure-tight piping as internal piping, the aqueous dispersion of the coalesced resin particles 19 decompressed to 1 MPa was flowed through the inside of the internal piping so as to be cooled down to 30° C. At this time, the pressure was found to stand at 0.9 MPa.

[Decompression Process]

With use of a multi-stage decompression device constructed by arranging pipe-shaped decompression members that are 1.0 mm in internal diameter one after another from the side of an inlet, the aqueous dispersion of the coalesced resin particles 19 was flowed through the inside of the pipe-shaped decompression members so as to be decompressed to an atmospheric pressure. At this time, the temperature was found to stand at 28° C.

The aqueous dispersion of the coalesced resin particles 19 thereby obtained was washed thoroughly with ion-exchanged water and then dried. In this way, the coalesced resin particles 19 were obtained.

[Classification Process]

The coalesced resin particles 19 were subjected to particle sizing treatment in a rotary classifier to remove oversized particles. In this way, a resin spacer of Example 19 was obtained.

Comparative Example 4

In constructing a resin spacer of Comparative example 4, the conditions of operation were basically the same as those adopted in Example 19, except that the level of pressure for the operation in the coalescence process was set at 0.45 MPa and the level of pressure for the operation in the before-cooling decompression process was set at 0.3 MPa.

Comparative Example 5

In constructing a resin spacer of Comparative example 5, the conditions of operation were basically the same as those adopted in Example 19, except that the level of pressure for the operation in the coalescence process was set at 15.05 MPa.

<Evaluation>

The resin spacers of Example 19 and Comparative examples 4 and 5 were evaluated for the following evaluative points. The results of evaluation are listed in Table 3.

[Resin Spacer Production Stability]

Out of Example and Comparative examples, the one that was formed into a resin spacer successfully under the corresponding conditions with stability was rated as "Good". On the other hand, the one that could not be formed into a resin spacer under the corresponding conditions because of a failure in the operation was rated as "Failure".

[Shape Factor SF1 (Sphericity) and Shape Factor SF2 (Irregularity)]

2.0 g of the resin spacer, 1 ml of sodium alkyl ether sulfate, and 50 ml of pure water were put into a 100 ml-beaker and subjected to thorough agitation to prepare a dispersion liquid. The dispersion liquid was treated with an ultrasonic homogenizer (manufactured by NISSEI) at a power output of 50 μA for 5 minutes for further dispersion. The dispersion liquid was left standing at rest for 6 hours, and then a supernatant fluid was removed. After that, with the addition of 50 ml of pure water, the dispersion liquid was agitated for 5 minutes by a magnetic stirrer, and whereafter subjected to suction filtration with use of a membrane filter (1 μm in bore diameter). The cleansed object remaining on the membrane filter was vacuum-dried in a desiccator containing silica gel substantially all through the night.

On the surface of the resin spacer particles that underwent surface cleaning in that way, there was formed a metal film (Au film having a film thickness of 0.5 μm) by means of sputter deposition. Then, 200 to 300 pieces of the particles taken in a random fashion from the thereby obtained metal film-coated resin spacer particle sample were photographed by a scanning electron microscope (trade name: S-570, manufactured by Hitachi, Ltd.) under conditions of an acceleration voltage of 5 kV and a magnification of 1000 times. The data of the electron photomicrograph was subjected to image analysis with use of an image analysis software (trade name:

A-ZO-KUN, manufactured by Asahi Kasei Engineering Corporation). The particle analysis parameters of the image analysis software called "A-ZO-KUN" are as follows: small graphic component removal area: 100 pixels, reduction-separation: 1 time; small graphic component: 1; number of times: 10, denoising filter: absent, shading: absent, a unit of result representation: μm. On the basis of the maximum length (MXLNG), perimeter (PERI), and graphic area (AREA) as to the particles obtained from the result of analysis, shape factors SF1 and SF2 were derived in accordance with the following formulae (3) and (4).

$$SF1=\{(MXLNG)2/\mathrm{AREA}\}\times(100\pi/4) \quad (3)$$

$$SF2=\{(\mathrm{PERI})2/\mathrm{AREA}\}\times(100/4\pi) \quad (4)$$

Out of Example and Comparative examples, the one that possesses SF1 as well as SF2 falling in a range of from 100 to 105 was rated as "Good". The one that possesses SF1 as well as SF2 falling outside this range was rated as "Failure".

[Comprehensive Evaluation]

The results of evaluation as to various evaluative points thus far described are expressed in the form of score (Good: 2 points; Middling: 1 point; Failure: 0 point). The criteria for the comprehensive evaluation are as follows.

Excellent: a score of 5 points or more

Good: a score of 4 points

Middling: a score of 3 points

Failure: a score of 2 points or less, or rated as "Failure" in one or more evaluative points

TABLE 3

| | Particle production stability | Shape factor SF1 | Shape factor SF2 | Comprehensive evaluation |
|---|---|---|---|---|
| Example 19 | Good | Good | Good | Excellent |
| Comparative example 4 | Failure | — | — | Failure |
| Comparative example 5 | Good | Failure | Failure | Failure |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing coalesced resin particles comprising:

a coalescence process of causing an aggregated resin particle slurry, which is prepared by dispersing in a fluid medium aggregated resin particles composed of an aggregate of fine resin particles containing at least a resin, to flow through an inside of a pipe while being heated to a predetermined temperature and pressurized in such a manner that a pressure exerted thereon falls in a range of 1 MPa or more and 2 MPa or less, thereby to obtain a coalesced resin particle slurry; and a cooling and decompression process of allowing the coalesced resin particle slurry flowing through the inside of the pipe in a heat and pressure-applied state to be cooled down to a predetermined temperature and decompressed to a predetermined pressure.

2. The method of claim 1, wherein the cooling and decompression process includes:

a before-cooling decompression step of decompressing the coalesced resin particle slurry flowing through the inside of the pipe in a heat and pressure-applied state to a pressure level of higher than an atmospheric pressure but lower than the pressure set for the coalescence process;

a cooling step of cooling down the coalesced resin particle slurry that has undergone pressure reduction in the before-cooling decompression step while being flowed through the inside of the pipe to a predetermined temperature; and a decompression step of decompressing the coalesced resin particle slurry that has been cooled in the cooling step while being flowed through the inside of the pipe to an atmospheric pressure.

3. The method of claim 1, wherein the predetermined temperature set for the coalescence process falls in a range of ((a softening temperature of the aggregated resin particles)−10)° C. or above and ((a softening temperature of the aggregated resin particles)+80)° C. or below.

4. The method of claim 1, wherein a specific heat of the aggregated resin particle slurry falls in a range of 4.3 J/g·° C. or more and 8.0 J/g·° C. or less.

5. The method of claim 1, wherein a volume average particle size of the aggregated resin particles falls in a range of 3 μm or more and 10 μm or less.

* * * * *